US011606995B1

(12) United States Patent
Skeen

(10) Patent No.: US 11,606,995 B1
(45) Date of Patent: Mar. 21, 2023

(54) DYNAMICALLY EXPANDABLE RIGID WAISTBAND SYSTEM

(71) Applicant: Aspen Defense LLC, Nampa, ID (US)

(72) Inventor: Steven Conner Skeen, Nampa, ID (US)

(73) Assignee: Aspen Defense LLC, Nampa, ID (US)

( * ) Notice: Subject to any disclaimer, the term of this patent is extended or adjusted under 35 U.S.C. 154(b) by 218 days.

(21) Appl. No.: 17/039,577

(22) Filed: Sep. 30, 2020

Related U.S. Application Data

(60) Provisional application No. 63/065,832, filed on Aug. 14, 2020.

(51) Int. Cl.
*A41F 9/02* (2006.01)
*A41F 9/00* (2006.01)

(52) U.S. Cl.
CPC ..... *A41F 9/025* (2013.01); *A41F 9/00* (2013.01); *A41F 9/02* (2013.01)

(58) Field of Classification Search
CPC ..... A41F 9/025; A41F 9/00; A41F 9/02
See application file for complete search history.

(56) References Cited

U.S. PATENT DOCUMENTS 780,751 A * 1/1905 Cress ..... A41F 9/025 2/339
899,831 A * 9/1908 Mastele ..... A41F 9/02 2/237
1,228,118 A * 5/1917 Kronenberger ..... A41F 9/025 2/339
1,692,312 A * 11/1928 Reichel ..... A41F 9/025 2/237
2,223,621 A * 12/1940 Knappenberger ..... A41F 9/00 2/237
2,435,315 A * 2/1948 Kreps ..... A41F 9/025 2/237
2,847,677 A * 8/1958 Robertson ..... A41F 9/025 2/221
3,091,772 A * 6/1963 Hebras ..... A41F 9/02 2/221
3,793,645 A * 2/1974 Kadison ..... A41F 9/025 2/221
5,283,910 A * 2/1994 Flint ..... A41F 9/025 2/221
5,638,550 A * 6/1997 Hube ..... A41F 9/002 2/920

(Continued)

*Primary Examiner* — Khaled Annis
(74) *Attorney, Agent, or Firm* — Hawley Troxell Ennis & Hawley LLP; Philip McKay

(57) ABSTRACT

A dynamically expandable rigid waistband system includes one or more rigid belt portions coupled to an expandable and adjustable waistband portion. The ends of one or more rigid belt portions are movably coupled to form a dynamically adjustable rigid belt ring. The dynamically adjustable rigid belt ring can expand or contract as the movably coupled ends of the one or more rigid belt portions move relative to each other by greater or smaller amounts. The dynamically adjustable rigid belt ring is then coupled to the expandable and adjustable waistband portion so that when the expandable and adjustable waistband portion expands or contracts, the dynamically adjustable rigid belt ring similarly expands or contracts to provide the comfort, range of motion, and adaptability of an expandable and adjustable waistband as well as a rigid structure for attaching devices safely and securely to the waistband.

11 Claims, 13 Drawing Sheets

(56) References Cited

U.S. PATENT DOCUMENTS 5,819,320 A * 10/1998 Jolla ..... A41F 9/00 2/227
5,881,933 A * 3/1999 Rogers ..... F41C 33/041 224/195
10,060,707 B2 * 8/2018 Searle ..... A41D 1/04
10,159,592 B2 * 12/2018 Ingimundarson ..... A61F 5/02
10,168,121 B2 * 1/2019 Gordon ..... F41C 33/048
10,251,467 B2 * 4/2019 Donhauser ..... A45F 3/12
10,271,663 B2 * 4/2019 Salazar ..... A47D 13/025
10,288,384 B2 * 5/2019 Kinnings ..... A45F 3/06
10,306,932 B1 * 6/2019 Martin ..... A61F 5/028
10,335,306 B2 * 7/2019 Okada ..... A61F 5/028
10,335,619 B2 * 7/2019 Colorado ..... A62B 35/0037
10,362,854 B2 * 7/2019 Willows ..... B65D 25/22
10,398,618 B2 * 9/2019 Dolce ..... A61H 3/008
10,420,412 B1 * 9/2019 Schlofman ..... A45F 3/12
2005/0223462 A1 * 10/2005 Snedeker ..... A41F 9/025 2/69
2009/0235431 A1 * 9/2009 Bevley ..... A41F 9/00 2/338
2014/0208484 A1 * 7/2014 Huff ..... A41F 9/02 2/243.1
2014/0259300 A1 * 9/2014 Iosilevich ..... A45F 3/14 2/300
2015/0135409 A1 * 5/2015 Mongan ..... A41F 9/00 2/312
2016/0100642 A1 * 4/2016 Swan ..... A45F 5/021 224/191
2016/0227861 A1 * 8/2016 May ..... A45F 5/02
2018/0023920 A1 * 1/2018 Boggs ..... F41C 33/041 224/674
2019/0342529 A1 * 11/2019 Piccioni ..... G01P 13/00
2020/0180263 A1 * 6/2020 Roup ..... A41D 27/00
2021/0022423 A1 * 1/2021 Cox ..... A41F 9/02
2021/0282484 A1 * 9/2021 Sekel ..... A41F 9/02
2021/0360994 A1 * 11/2021 Takada ..... A41F 9/00

* cited by examiner

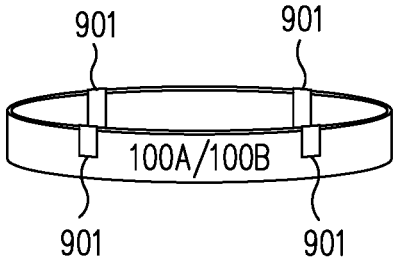
FIG. 9A
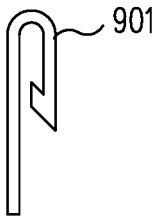
FIG. 9B
FIG. 9C
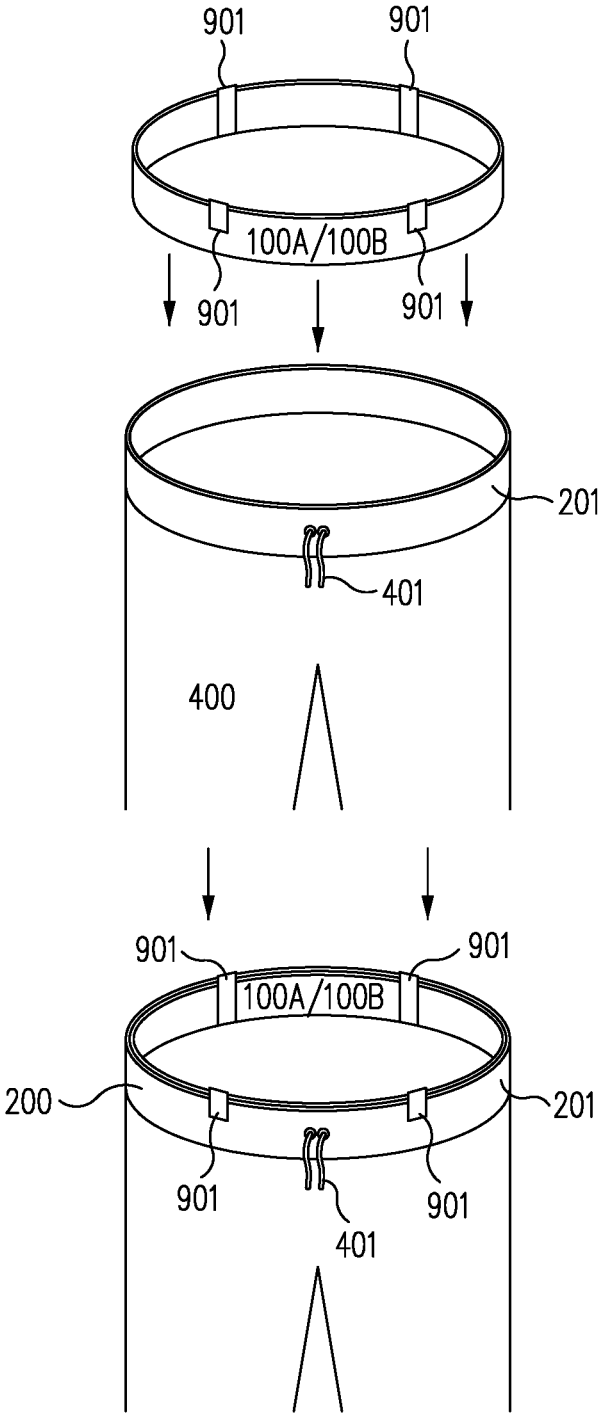
FIG. 9D

DYNAMICALLY EXPANDABLE RIGID WAISTBAND SYSTEM

RELATED APPLICATION

This application claims the benefit of Steven Conner Skeen, U.S. Provisional Application No. 63/065,832, filed on Aug. 14, 2020, titled "DYNAMICALLY EXPANDABLE RIGID WAISTBAND SYSTEM," which is hereby incorporated by reference in its entirety as if it were fully set forth herein.

BACKGROUND

Expandable and adjustable waistbands, such as elastic waistbands and drawstring waistbands, are an extremely popular feature of many types of garments such as pants, skirts, and active wear. The popularity of expandable and adjustable waistbands arises from the fact that expandable and adjustable waistbands provide adaptability, comfort, and range of motion that fixed waistbands and belts simply cannot provide. This is often a critical feature for active wear and casual wear.

However, one disadvantage of expandable and adjustable waistbands is that these type of waistbands are, by definition, non-rigid. Consequently, traditional expandable and adjustable waistbands are not well suited for use with garments where a rigid waistband, such as would be provided by a traditional leather, nylon, or otherwise rigid, belt is needed. For example, it is often desirable to have a rigid waistband when carrying a holster, tools, or any other device that needs to be secured to a rigid platform such as a traditional leather, nylon, or otherwise rigid, belt. Consequently, a consumer is often forced to choose between the comfort, range of motion, and adaptability of an expandable and adjustable waistband or the ability to carry devices safely and securely such as a holsters/firearms or tools.

In the case of holsters/firearms this is a particularly significant issue. This is because a typical holster needs to be attached to a rigid structure, such as a traditional leather or nylon belt, to prevent the holster and firearm from falling out of the waistband, changing position, and to allow the firearm to be drawn from the holster, and/or returned to the holster, without the holster coming out of the waistband or changing position. Absent this rigid structure for holster attachment, several potentially dangerous situations may arise.

First, as noted, the holster and firearm may fall out of the waistband, thereby causing the firearm to be dropped. This can not only damage the firearm and cause some alarm to bystanders, but it can also, in some cases, result in an accidental discharge of the firearm.

Second, absent a rigid structure to secure the holster, the holster can easily shift position. When this happens before a firearm is drawn, it is plausible that just at the time when that firearm might be needed, the holster and firearm cannot be located and/or readily drawn. On the other hand, if the holster position shifts, the owner may miss the holster when attempting to return the firearm to the holster. This again can result in the firearm being dropped and creating the dangerous situation discussed above.

Third, absent a rigid structure to secure the holster, there is a temptation to abandon the holster and simply carry the firearm in a pocket, or just pushed inside the waist band which, by definition, is non-rigid and not intended, or capable, of safely supporting a firearm. This not only again increases the likelihood the firearm will be dropped, but it also results in the trigger and hammer mechanisms being uncovered. This is problematic because absent a holster to protect the trigger area, firearms are far more subject to accidental discharge. This is because when a trigger and/or hammer of a firearm is not covered by a holster there a substantial chance the trigger or hammer will catch or snag on clothing, such as an expandable waistband or shirt, and thereby be accidentally operated. As noted, this results in a significantly higher chance of accidental discharge and injury to the wearer and/or bystanders.

Similarly, absent a rigid structure to secure a tool or other device to be carried by a wearer, the tool or other device can be dropped thereby causing damage to the tool or other device. In addition, the dropping of the tool or other device can cause injury to others, particularly if the tool or other device is being carried above ground level on a structure such as a scaffolding, or other construction/workplace elevated location.

For these and many other reasons, using traditional systems, expandable and adjustable waistbands are not well suited for use with holsters and firearms. To address this issue, attempts have been made to essentially integrate a rigid gun or tool belt with an expandable and adjustable waistband garment. However, these attempted solutions did little more than relocate a traditional rigid belt to the inside of the expandable and adjustable waistband. Consequently, when the integrated rigid gun or tool belt was adjusted and secured, the expandability and adjustability of the waistband was negated because once the integrated traditional rigid gun or tool belt was secure, the waistband system was no longer dynamically expandable or in any way dynamically adjustable and therefore failed to provide the comfort, adaptability, and range of motion so desirable in expandable and adjustable waist band garments.

What is needed is a method and system of providing the comfort, range of motion, and adaptability of an expandable and adjustable waistband along with a rigid structure for attaching devices, such as a holster/firearm or tool, safely and securely to the waistband.

SUMMARY

Embodiments of the present disclosure provide a solution to the long-standing technical problem of providing the comfort, range of motion, and adaptability of an expandable and adjustable waistband as well as a rigid structure for attaching devices, such as a holster/firearm or tool, safely and securely to the waistband.

To this end, in one embodiment, a dynamically expandable rigid waistband system is disclosed that includes one or more rigid belt portions coupled to an expandable and adjustable waistband portion. In one embodiment, the ends of one or more rigid belt portions movably overlap each other to form a dynamically adjustable rigid belt ring. In another embodiment, the ends of one or more rigid belt portions are connected to each other with expandable material to form a dynamically adjustable rigid belt ring. In one embodiment, the dynamically adjustable rigid belt ring can freely expand or contract, i.e., the circumference of the dynamically adjustable rigid belt ring can increase or decrease, as the movably overlapping, or elastically connected, ends of the one or more rigid belt portions are free to slide past each other, and thereby overlap each other by greater or smaller amounts, or the elastically connected ends expand and contract.

The dynamically adjustable rigid belt ring is then coupled to the expandable and adjustable waistband portion of a parent garment so that when the expandable and adjustable waistband portion expands or contracts, the dynamically adjustable rigid belt ring also expands or contracts, i.e., the circumference of the dynamically adjustable rigid belt ring increases or decreases, as the movably overlapping ends of the one or more rigid belt portions freely slide past each other and overlap each other by greater or smaller amounts or the elastically connected ends expand and contract. As a result, as the expandable and adjustable waistband portion expands or contracts, the dynamically adjustable rigid belt ring also expands or contracts by a substantially similar amount automatically.

Consequently, the wearer of the disclosed dynamically expandable rigid waistband system is provided the comfort, range of motion, and adaptability of an expandable and adjustable waistband as well as a rigid structure for attaching devices, such as a holster/firearm or tool, safely and securely to the waistband.

As discussed in more detail below, the disclosed embodiments provide a solution to the long-standing technical problem of providing the comfort, range of motion, and adaptability of an expandable and adjustable waistband as well as a rigid structure for attaching devices, such as a holster/firearm or tool, safely and securely to the waistband.

BRIEF DESCRIPTION OF THE DRAWINGS

Common reference numerals are used throughout the figures and the detailed description to indicate like elements. One skilled in the art will readily recognize that the above figures are merely illustrative examples and that other architectures, modes of operation, orders of operation, and elements/functions can be provided and implemented without departing from the characteristics and features of the invention, as set forth in the claims.

FIG. 9A shows a disclosed dynamically adjustable rigid belt ring, such as those shown in FIG. 1A or 1B, with four attachment clips for removably attaching the disclosed dynamically adjustable rigid belt ring to the expandable waistband portion of a garment in accordance with one embodiment.

FIG. 9B shows one illustrative example of an attachment clip for removably attaching the disclosed dynamically adjustable rigid belt ring to the expandable waistband portion of a garment in accordance with one embodiment.

FIG. 9C shows the disclosed dynamically adjustable rigid belt ring, such as those shown in FIG. 1A or 1B, with four attachment clips of FIG. 9A being positioned to be removably attached to the expandable waistband portion of the pair of athletic pants of FIG. 4 in accordance with one embodiment.

FIG. 9D shows the disclosed dynamically adjustable rigid belt ring, such as those shown in FIG. 1A or 1B, removably attached to the expandable waistband portion of the pair of athletic pants of FIG. 4 using the four attachment clips of FIG. 9A in accordance with one embodiment.

DETAILED DESCRIPTION

Figure 1A:
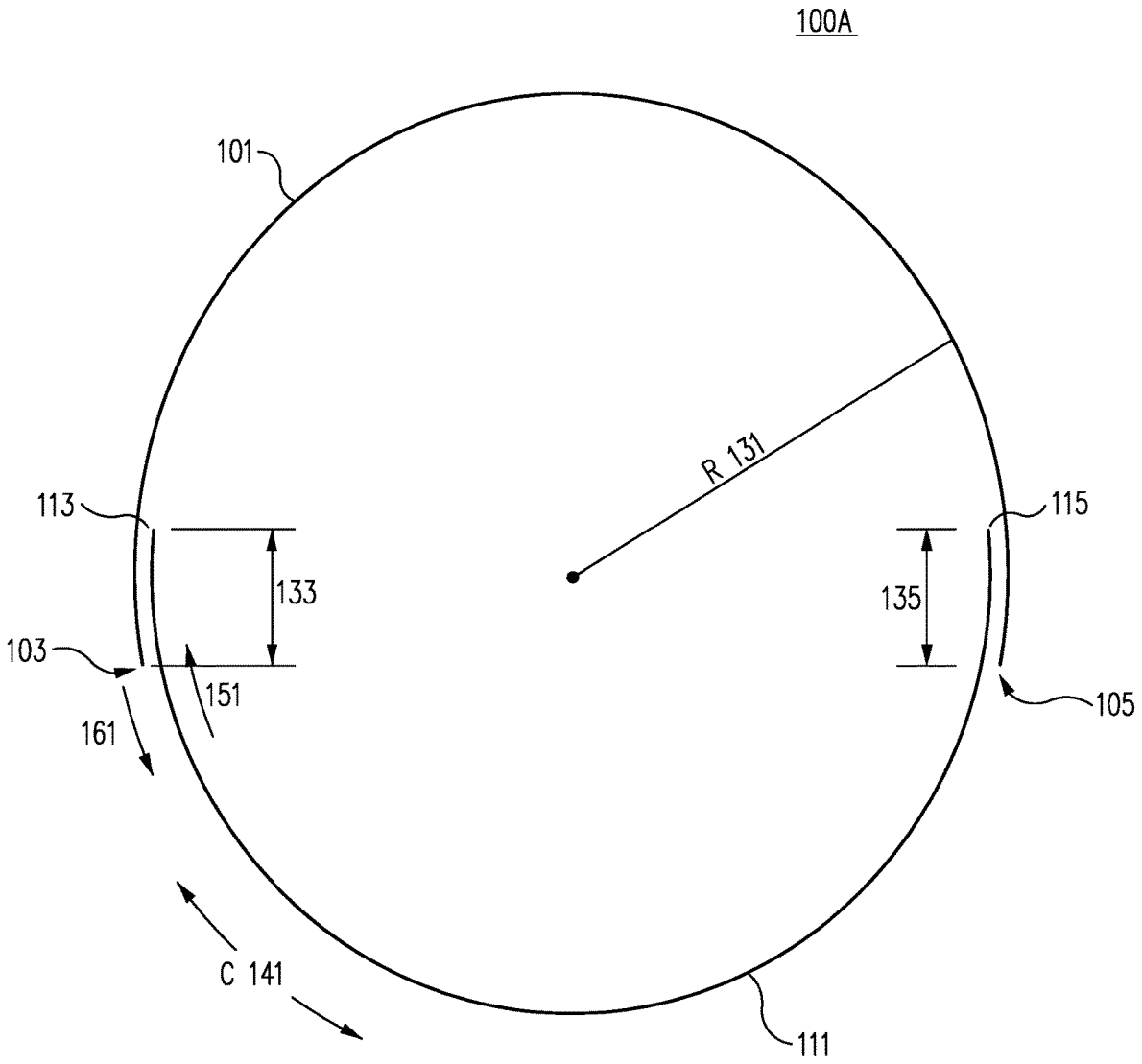
FIG. 1A shows a dynamically adjustable rigid belt ring made up of one or more overlapping rigid belt portions in accordance with one embodiment.

Embodiments will now be discussed with reference to the accompanying figures, which depict one or more exemplary embodiments. Embodiments may be implemented in many different forms and should not be construed as limited to the embodiments set forth herein, shown in the figures, or described below. Rather, these exemplary embodiments are provided to allow a complete disclosure that conveys the principles of the invention, as set forth in the claims, to those of skill in the art.

A dynamically expandable rigid waistband system is disclosed herein. In one embodiment, the dynamically expandable rigid waistband system includes an expandable waistband portion, the expandable waistband portion having a circumference that can dynamically increase and decrease.

In one embodiment, the dynamically expandable rigid waistband system also includes one or more overlapping rigid belt portions. In one embodiment, the one or more rigid belt portions each have rigid belt portion ends that are free to movably overlap each other to form a dynamically adjustable rigid belt ring. In one embodiment, the dynamically adjustable rigid belt ring thereby has a dynamically adjustable rigid belt ring circumference that can increase or decrease as the movably overlapping ends of the one or more rigid belt portions freely slide past each other to overlap each other by greater or smaller amounts.

In one embodiment, the dynamically adjustable rigid belt ring is coupled to the expandable waistband portion such that when the expandable and adjustable waistband portion circumference increases the dynamically adjustable rigid belt ring circumference also increases automatically as the movably overlapping ends of the one or more rigid belt portions freely slide past each other and overlap each other by smaller amounts. Similarly, when the expandable and adjustable waistband portion circumference decreases, the dynamically adjustable rigid belt ring circumference also decreases automatically as the movably overlapping ends of the one or more rigid belt portions freely slide past each other and overlap each other by greater amounts.

In another embodiment, the dynamically expandable rigid waistband system includes an expandable waistband portion, the expandable waistband portion having a circumference that can dynamically increase and decrease.

In one embodiment, the dynamically expandable rigid waistband system also includes one or more elastically coupled rigid belt portions. In one embodiment, the one or more rigid belt portions each have rigid belt portion ends that are elastically coupled each other by an elastic connector portion to form a dynamically adjustable rigid belt ring. In one embodiment, the dynamically adjustable rigid belt ring thereby has a dynamically adjustable rigid belt ring circumference that can increase or decrease as the elastically coupled ends of the one or more rigid belt portions expand or contract.

In one embodiment, the dynamically adjustable rigid belt ring is coupled to the expandable waistband portion such that when the expandable and adjustable waistband portion circumference increases the dynamically adjustable rigid belt ring circumference also increases automatically as the elastically coupled ends of the one or more rigid belt portions move away from each other as the elastic connector portion expands. Similarly, when the expandable and adjustable waistband portion circumference decreases, the dynamically adjustable rigid belt ring circumference also decreases automatically as the elastically coupled ends of the one or more rigid belt portions move towards each other in response to the contracting elastic connector portion.

Consequently, the disclosed embodiments provide a solution to the long-standing technical problem of providing the comfort, range of motion, and adaptability of an expandable and adjustable waistband as well as a rigid structure for attaching devices, such as a holster/firearm or tool, safely and securely to the waistband.

FIG. 1A shows a dynamically adjustable rigid belt ring 100A made up of two rigid belt portions 101 and 111 in accordance with one embodiment.

As seen in FIG. 1A, dynamically adjustable rigid belt ring 100A includes a first rigid belt portion 101 having end portions 103 and 105. As seen in FIG. 1A, dynamically adjustable rigid belt ring 100A includes a second rigid belt portion 111 having end portions 113 and 115.

In various embodiments, rigid belt portions 101 and 111 can be any rigid material such as, but not limited to, nylon, polymer, leather, metal, or any other rigid material suitable for attaching devices such as a holster or a tool, as discussed herein, and/or as known in the art at the time of filing, and/or as developed/made known after the time of filing.

As seen in FIG. 1A, end portion 103 of first rigid belt portion 101 overlaps end portion 113 of second rigid belt portion 111 by an amount or length 133. Likewise, end portion 105 of first rigid belt portion 101 overlaps end portion 115 of second rigid belt portion 111 by an amount or length 135.

In one embodiment, end portion 103 of first rigid belt portion 101 and end portion 113 of second rigid belt portion 111 movably overlap, i.e., end portion 103 and end portion 113 can freely slide past each other in either direction 151 or 161, such that the overlap amount or length 133 can dynamically, i.e., automatically, adjust. Likewise, in one embodiment, end portion 105 of first rigid belt portion 101 and end portion 115 of second rigid belt portion 111 movably overlap, i.e., end portion 105 and end portion 115 can freely slide past each other in either direction 151 or 161, such that the overlap amount or length 135 can dynamically, i.e., automatically, adjust.

Of note, in some embodiments (not shown), dynamically adjustable rigid belt ring 100A is made up of a single rigid belt portion with only two ends. In these embodiments, the two ends of the single rigid belt portion overlap and can freely slide past each other to overlap each other by greater or smaller amounts.

This ability of end portions 103 and 113 and end portions 105 and 115 to freely slide past each other in either direction 151 or 161 results in the ability to dynamically, i.e., automatically, increase or decrease the circumference C 141, and radius R 131, of dynamically adjustable rigid belt ring 100A. Consequently, dynamically adjustable rigid belt ring 100A thereby has a dynamically adjustable rigid belt ring circumference C 141 that can dynamically, i.e., automatically, increase or decrease as the movably overlapping end portions 103/113 and 105/115 of the rigid belt portions 101 and 111 are free to slide past each other and overlap each other by greater or smaller amounts 133 and 135.

As discussed in more detail below, in one embodiment, dynamically adjustable rigid belt ring 100A is then coupled, attached to, or otherwise integrated with, an expandable waistband portion, the expandable waistband portion having a circumference that can increase and decrease.

Figure 2A:
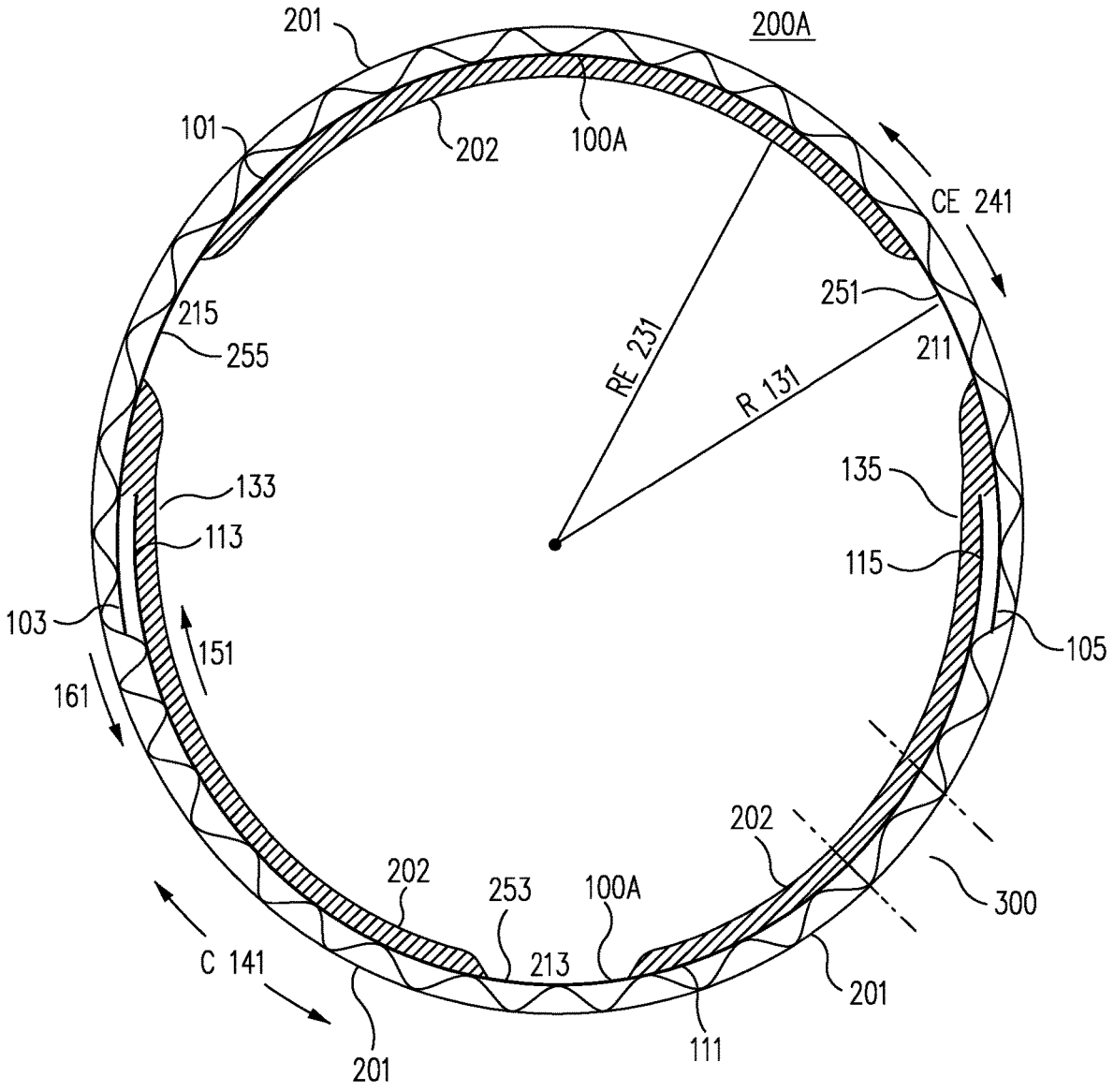
FIG. 2A shows a dynamically expandable rigid waistband system including the dynamically adjustable rigid belt ring made up of one or more overlapping rigid belt portions of FIG. 1A coupled to an expandable and adjustable waistband portion.

FIGS. 1A and 2A shows a dynamically expandable rigid waistband system 200A including the dynamically adjustable rigid belt ring 100A made up of the two rigid belt portions 101 and 111 of FIG. 1A coupled to an expandable and adjustable waistband portion 201.

As seen in FIG. 2A, dynamically adjustable rigid belt ring 100A including the two rigid belt portions 101 and 111 is coupled to expandable waistband portion 201. In the specific illustrative embodiment of FIG. 2A, dynamically adjustable rigid belt ring 100A is coupled to expandable waistband portion 201 by being sewn inside a channel 202 which is, in turn, sewn or otherwise coupled to expandable waistband portion 201 with pockets or attachment gaps 211, 213, and 215 in channel 202 where a device, such as a holster or tool, can be directly attached to dynamically adjustable rigid belt ring 100A at portions 251, 253, and 255 of dynamically adjustable rigid belt ring 100A in this specific illustrative example.

In various embodiments, expandable waistband portion 201 can be, or can include, but is not limited to: elastic material, such as rubber or rubber compounds or synthetics; elastic material combined with cloth; elastic material combined with cotton; elastic material combined with any textile material; a draw string; a draw string combined with cloth, cotton or any other textile material; or any other expandable waistband material capable of dynamically expanding and contracting, as discussed herein, and/or as known in the art at the time of filing, and/or as developed/made know after the time of filing.

As noted above, end portion 103 of first rigid belt portion 101 and end portion 113 of second rigid belt portion 111 movably overlap, i.e., end portion 103 and end portion 113 can freely slide past each other in either direction 151 or 161, such that the overlap amount or length 133 can dynamically, i.e., automatically, adjust. Likewise, in one embodiment, end portion 105 of first rigid belt portion 101 and end portion 115 of second rigid belt portion 111 movably overlap, i.e., end portion 105 and end portion 115 can freely slide past each other in either direction 151 or 161, such that the overlap amount or length 135 can dynamically, i.e., automatically, adjust. This ability of end portions 103 and 113 and end portions 105 and 115 to freely slide past each other in either direction 151 or 161 results in the ability to dynamically, i.e., automatically, increase or decrease the circumference C 141, and radius R 131, of dynamically adjustable rigid belt ring 100A.

Consequently, dynamically adjustable rigid belt ring 100A thereby has a dynamically adjustable rigid belt ring circumference C 141 that can automatically increase or decrease as the movably overlapping end portions 103/113 and 105/115 of the rigid belt portions 101 and 111 freely slide past each other and overlap each other by greater or smaller amounts 133 and 135.

As seen in FIG. 2A expandable waistband portion 201 has an adjustable radius RE 231 and adjustable circumference CE 241. In one embodiment, when adjustable circumference CE 241 of expandable waistband portion 201 increases the circumference C 141 of dynamically adjustable rigid belt ring 100A, coupled to the expandable waistband portion 201, also increases automatically as the movably overlapping end portions 103/113 and 105/115 of the two rigid belt portions 101 and 111 freely slide past each other in channel 202 and overlap each other by smaller amounts 133 and 135.

Similarly, when adjustable circumference CE 241 of expandable waistband portion 201 decreases the circumference C 141 of dynamically adjustable rigid belt ring 100A, coupled to the expandable waistband portion 201, also decreases automatically as the movably overlapping end portions 103/113 and 105/115 of the two rigid belt portions 101 and 111 freely slide past each other in channel 202 and overlap each other by larger amounts 133 and 135.

Consequently, the disclosed dynamically expandable rigid waistband system 200A provides a solution to the long-standing technical problem of providing the comfort, range of motion, and adaptability of an expandable and adjustable waistband as well as a rigid structure for attaching devices, such as a holster/firearm or tool, safely and securely to the waistband.

Figure 1B:
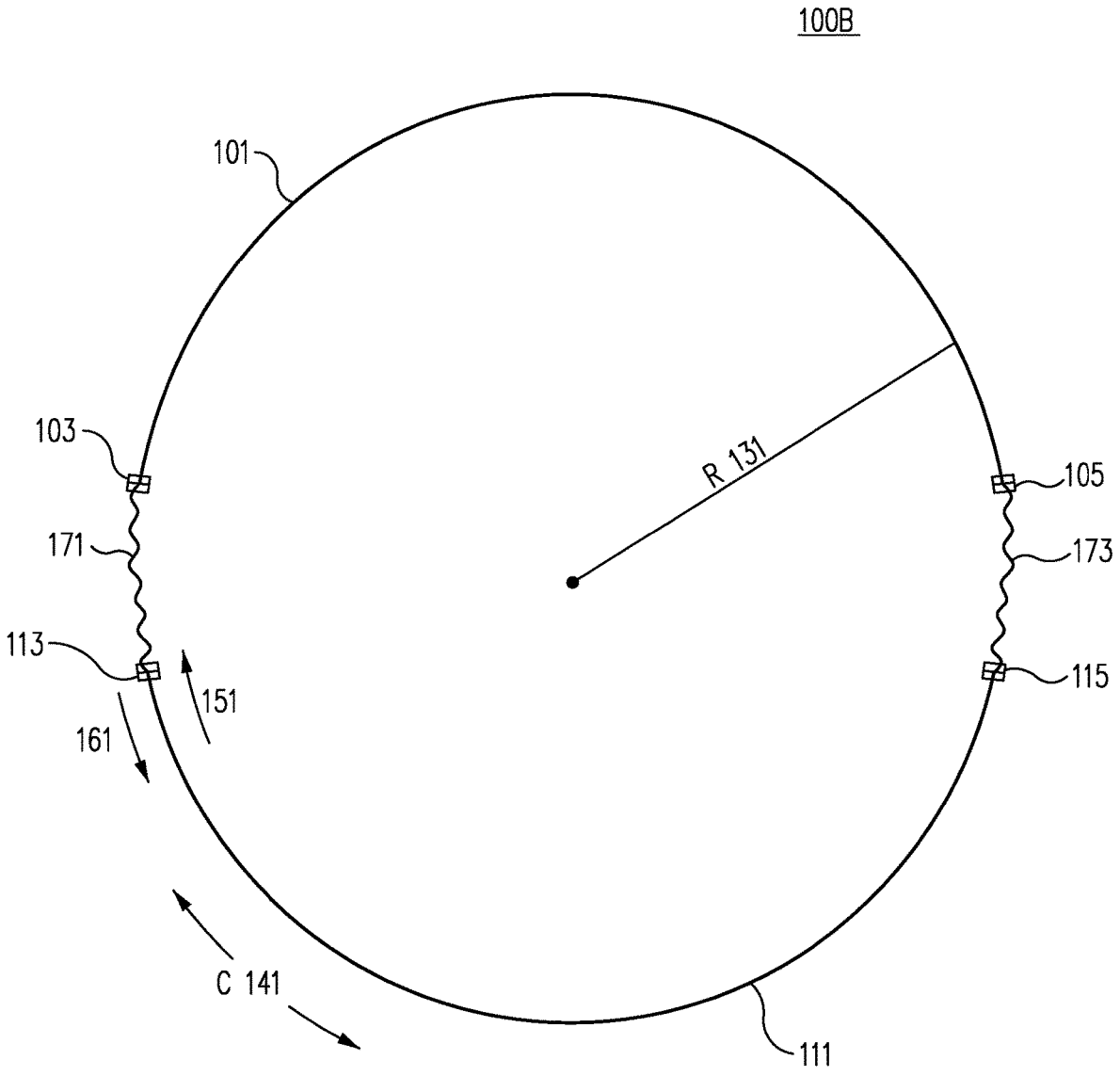
FIG. 1B shows a dynamically adjustable rigid belt ring made up of one or more elastically connected rigid belt portions in accordance with one embodiment.

FIG. 1B shows a dynamically adjustable rigid belt ring 100B made up of two rigid belt portions 101 and 111 in accordance with one embodiment.

As seen in FIG. 1B, dynamically adjustable rigid belt ring 100B includes a first rigid belt portion 101 having end portions 103 and 105. As seen in FIG. 1B, dynamically adjustable rigid belt ring 100B includes a second rigid belt portion 111 having end portions 113 and 115.

In various embodiments, rigid belt portions 101 and 111 can be any rigid material such as, but not limited to, nylon, polymer, leather, metal, or any other rigid material suitable for attaching devices such as a holster or a tool, as discussed herein, and/or as known in the art at the time of filing, and/or as developed/made known after the time of filing.

As seen in FIG. 1B, end portion 103 of first rigid belt portion 101 is elastically coupled to end portion 113 of second rigid belt portion 111 by elastic connector portion 171. Likewise, in one embodiment end portion 105 of first rigid belt portion 101 is elastically coupled to end portion 115 of second rigid belt portion 111 by elastic connector portion 173.

Of note, in some embodiments (not shown), dynamically adjustable rigid belt ring 100B is made up of a single rigid belt portion with only two ends. In these embodiments, the two ends of the single rigid belt portion are elastically coupled to each other with a single elastic portion.

In various embodiments, elastic connector portion 171 and/or elastic connector portion 173 can be, or can include, but is not limited to: elastic material, such as rubber or rubber compounds or synthetics; elastic material combined with cloth; elastic material combined with cotton; elastic material combined with any textile material; or any other elastic material capable of dynamically expanding and contracting, as discussed herein, and/or as known in the art at the time of filing, and/or as developed/made know after the time of filing.

In one embodiment, end portion 103 of first rigid belt portion 101 and end portion 113 of second rigid belt portion 111 can dynamically and movably expand or contract, i.e., end portion 103 and end portion 113 can move closer or further from each other by the expansion or contraction of elastic connector portion 171. Likewise, in one embodiment, end portion 105 of first rigid belt portion 101 and end portion 115 of second rigid belt portion 111 can dynamically and movably expand or contract, i.e., end portion 105 and end portion 115 can move closer or further from each other by the expansion or contraction of elastic connector portion 173.

This ability of end portions 103 and 113 and end portions 105 and 115 to dynamically and movably expand or contract in either direction 151 or 161 results in the ability to dynamically increase or decrease the circumference C 141, and radius R 131, of dynamically adjustable rigid belt ring 100B. Consequently, dynamically adjustable rigid belt ring 100B thereby has a dynamically adjustable rigid belt ring circumference C 141 that can dynamically increase or decrease as the dynamically and movably end portions 103/113 and 105/115 of the rigid belt portions 101 and 111 elastically move closer or further from each other as the elastic connector portions 171/173 expand or contract by greater or smaller amounts 133 and 135.

As discussed in more detail below, in one embodiment, dynamically adjustable rigid belt ring 100B is then coupled, attached to, or otherwise integrated with, an expandable waistband portion, the expandable waistband portion having a circumference that can increase and decrease.

Figure 2B:
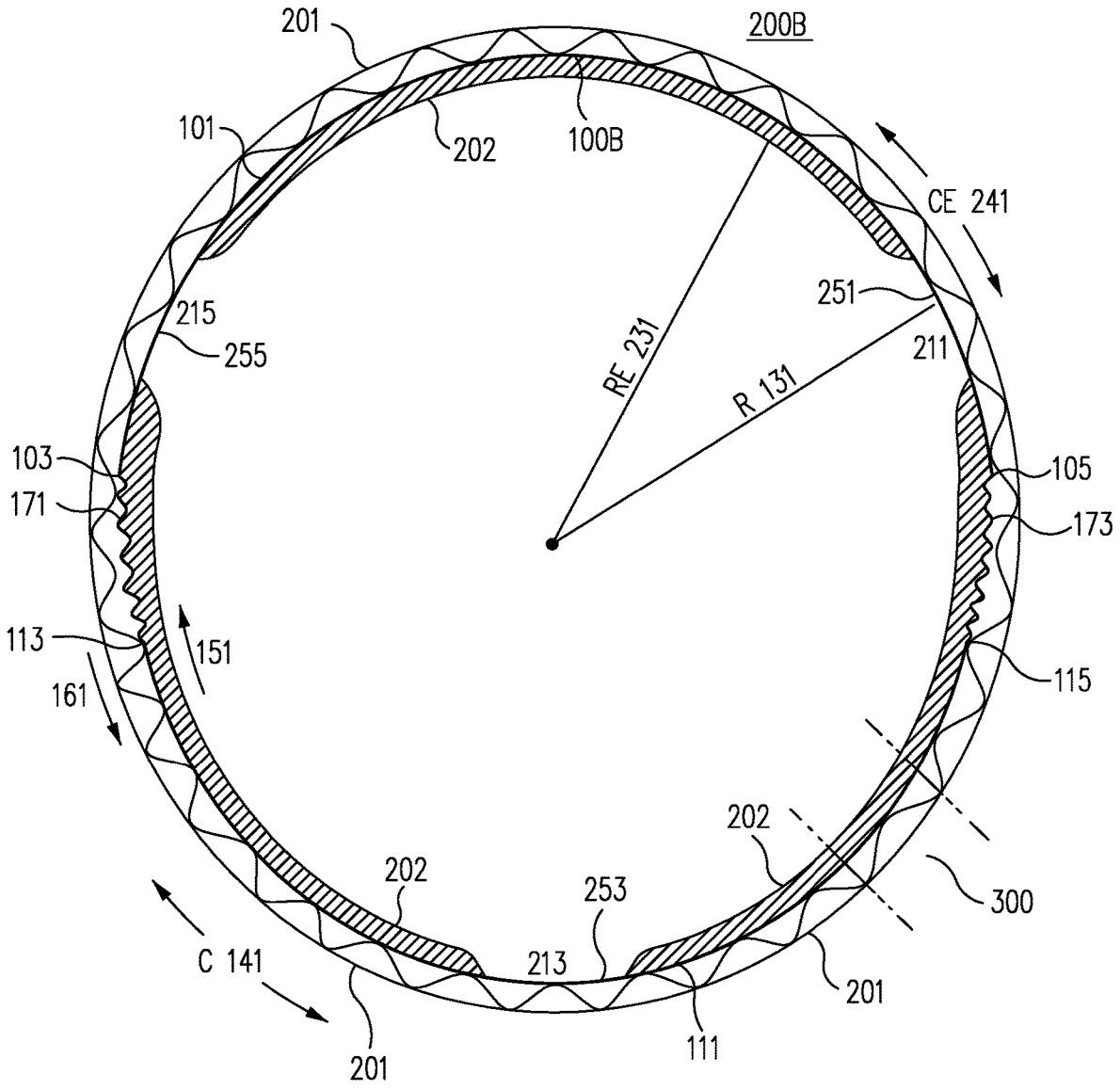
FIG. 2B shows a dynamically expandable rigid waistband system including the dynamically adjustable rigid belt ring made up of one or more elastically connected rigid belt portions of FIG. 1B coupled to an expandable and adjustable waistband portion.

FIG. 2B shows a dynamically expandable rigid waistband system 200B including the dynamically adjustable rigid belt ring 100B made up of the two rigid belt portions 101 and 111 of FIG. 1B coupled to an expandable and adjustable waistband portion 201.

As seen in FIG. 2B, dynamically adjustable rigid belt ring 100B including the two rigid belt portions 101 and 111 is coupled to expandable waistband portion 201. In the specific illustrative embodiment of FIG. 2B, dynamically adjustable rigid belt ring 100B is coupled to expandable waistband portion 201 by being sewn inside a channel 202 which is, in turn, sewn or otherwise coupled to expandable waistband portion 201 with pockets or attachment gaps 211, 213, and 215 in channel 202 where a device, such as a holster or tool, can be directly attached to dynamically adjustable rigid belt ring 100B at portions 251, 253, and 255 of dynamically adjustable rigid belt ring 100B in this specific illustrative example.

In various embodiments, expandable waistband portion 201 can be, or can include, but is not limited to: elastic material, such as rubber or rubber compounds or synthetics; elastic material combined with cloth; elastic material combined with cotton; elastic material combined with any textile material; a draw string; a draw string combined with cloth, cotton or any other textile material; or any other expandable waistband material capable of dynamically expanding and contracting, as discussed herein, and/or as known in the art at the time of filing, and/or as developed/made know after the time of filing.

As noted above, end portion 103 of first rigid belt portion 101 and end portion 113 of second rigid belt portion 111 are movably and elastically coupled by elastic connector portion 171, i.e., end portion 103 and end portion 113 can dynamically move closer or further from each other in either direction 151 or 161 as elastic connector portion 171 contracts or expands. Likewise, in one embodiment, end portion 105 of first rigid belt portion 101 and end portion 115 of second rigid belt portion 111 can dynamically move closer or further from each other in either direction 151 or 161 as elastic connector portion 173 contracts or expands. This ability of end portions 103 and 113 and end portions 105 and 115 to dynamically move closer or further from each other by virtue of the contraction or expansion of elastic connector portions 171 and 173 results in the ability to dynamically increase or decrease the circumference C 141, and radius R 131, of dynamically adjustable rigid belt ring 100B.

Consequently, dynamically adjustable rigid belt ring 100B thereby has a dynamically adjustable rigid belt ring circumference C 141 that can increase or decrease as end portions 103/113 and 105/115 of the rigid belt portions 101 and 111 dynamically move closer or further from each other by virtue of the contraction or expansion of elastic connector portions 171 and 173.

As seen in FIG. 2B expandable waistband portion 201 has an adjustable radius RE 231 and adjustable circumference CE 241. In one embodiment, when adjustable circumference CE 241 of expandable waistband portion 201 increases the circumference C 141 of dynamically adjustable rigid belt ring 100B, coupled to the expandable waistband portion 201, also increases automatically as end portions 103/113 and 105/115 of the rigid belt portions 101 and 111 dynamically move further from each other by virtue of the expansion of elastic connector portions 171 and 173.

Similarly, when adjustable circumference CE 241 of expandable waistband portion 201 decreases the circumference C 141 of dynamically adjustable rigid belt ring 100B, coupled to the expandable waistband portion 201, also decreases automatically as end portions 103/113 and 105/115 of the rigid belt portions 101 and 111 dynamically move closer to each other automatically by virtue of the contraction of elastic connector portions 171 and 173 by amounts 133 and 135.

Consequently, the disclosed dynamically expandable rigid waistband system 200B provides a solution to the long-standing technical problem of providing the comfort, range of motion, and adaptability of an expandable and adjustable waistband as well as a rigid structure for attaching devices, such as a holster/firearm or tool, safely and securely to the waistband.

Figure 3A:
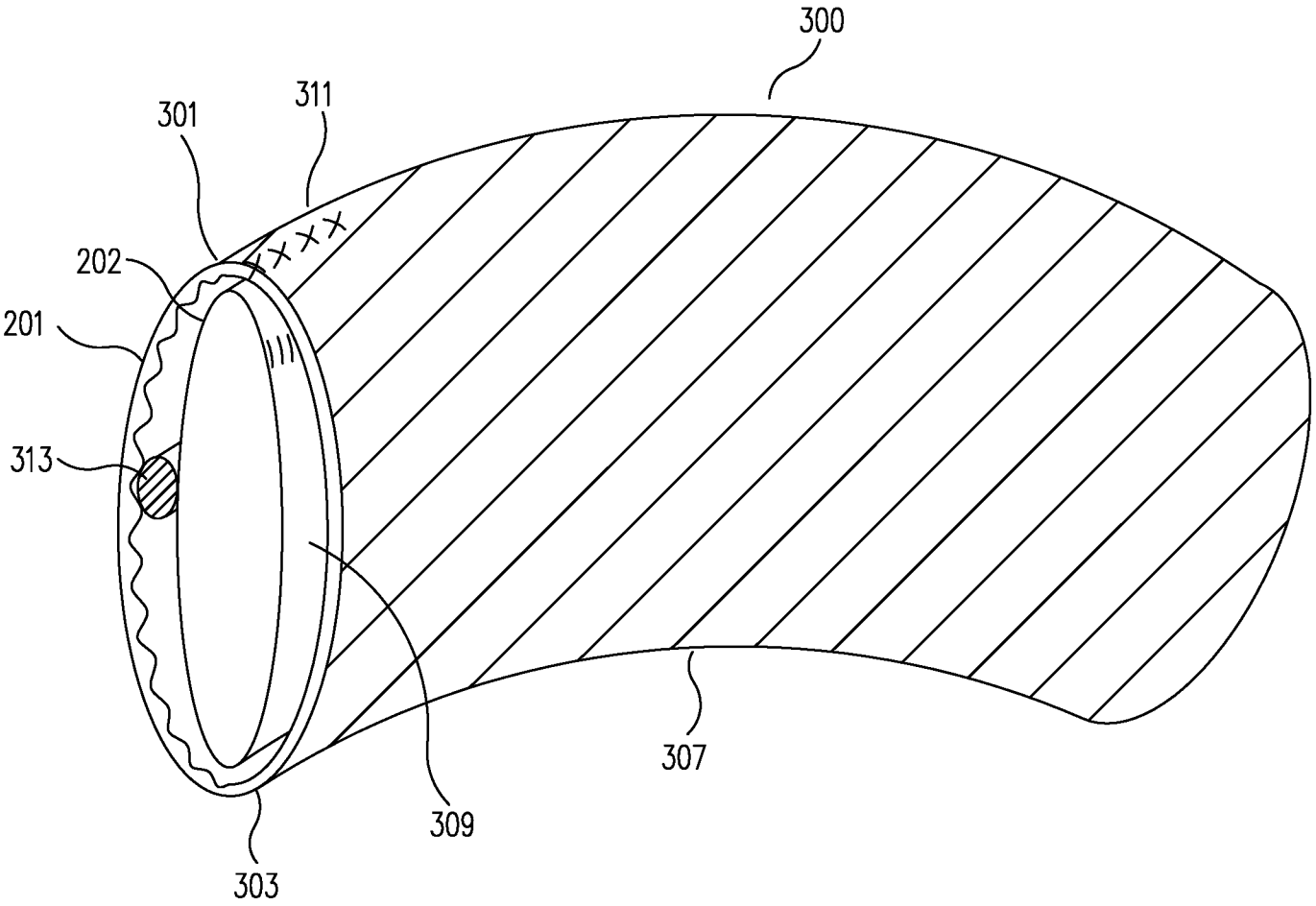
FIG. 3A is a cut away perspective view of an inner portion of the dynamically expandable rigid waistband systems of FIGS. 2A and 2B.

FIG. 3A is a cut away perspective view of the inner portion 300 (FIG. 2) of the dynamically expandable rigid waistband system of FIGS. 2A and 2B. Referring to FIG. 2A, 2B, and FIG. 3A together, shown in FIG. 3A is upper 301 and lower 303 portions of expandable waistband 201 and portion 307 of channel 202. As seen in FIG. 3A, portion 309 of rigid belt portion 111 is positioned in portion 307 of channel 202 and attached to upper portion 301 of expandable waistband portion 201 by attachment material/stitches 311.

Also shown in the specific illustrative example of FIG. 3A is a portion 313 of a drawstring that is also within channel 202 and runs parallel to the motion of rigid belt portion 111 in channel 202.

Figure 3B:
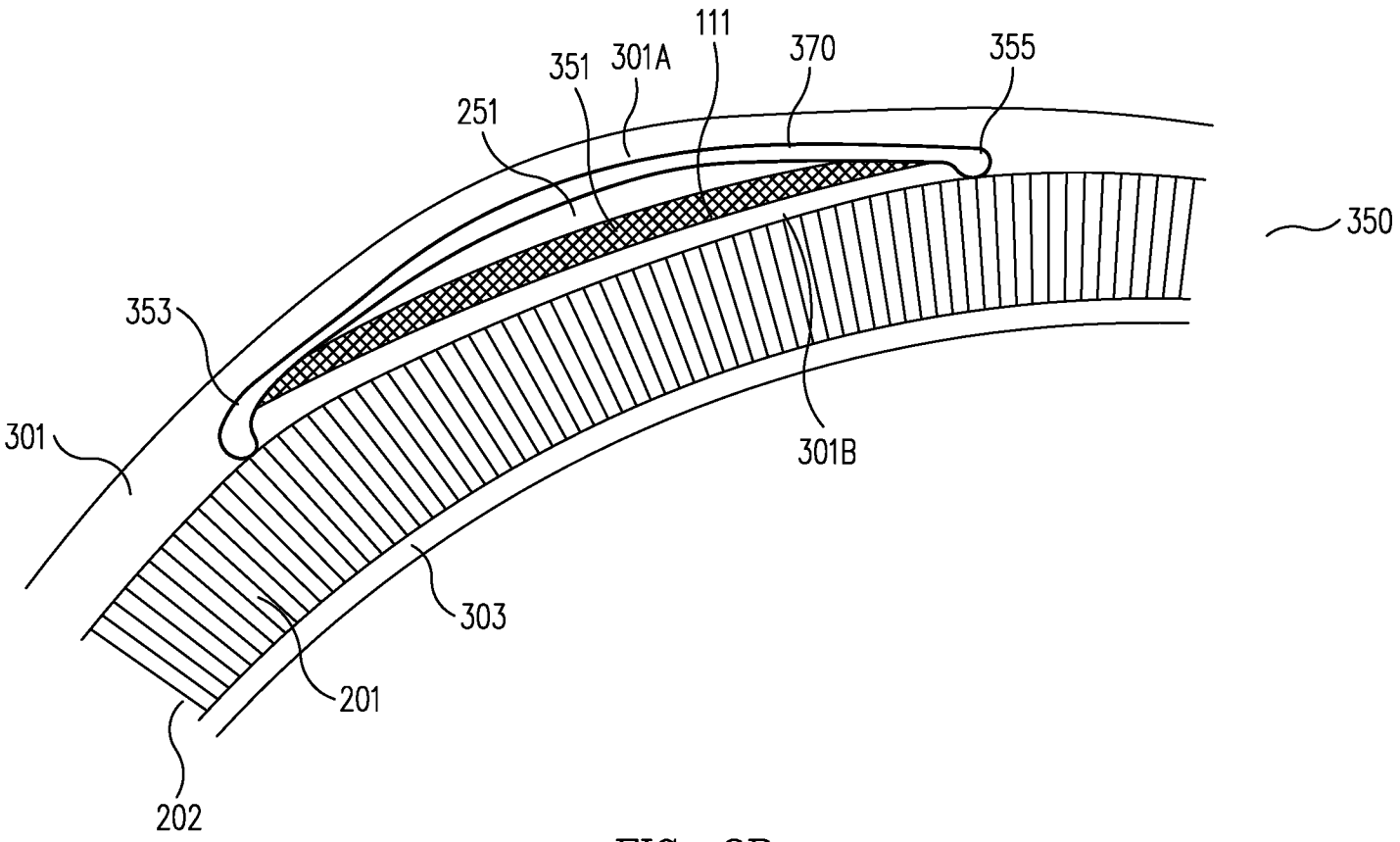
FIG. 3B is a representation of one illustrative example of a of the disclosed dynamically expandable rigid waistband system such as those shown in FIG. 2A or 2B including a representation of one example of a pocket or attachment gap where a device, such as a holster or tool, can be attached to dynamically adjustable rigid belt ring in accordance with one embodiment.

FIG. 3B is a representation of one illustrative example of a of the disclosed dynamically expandable rigid waistband system, such as those shown in FIG. 2A or 2B and as discussed above, including a representation of one example of a pocket or attachment gap 251 where a device, such as a holster or tool, can be attached to dynamically adjustable rigid belt ring in accordance with one embodiment.

Referring to FIG. 2A or 2B, 3A and 3B together, FIG. 3B, includes upper 301 and lower 303 portions of expandable waistband 201 and channel 202. In this specific illustrative example, pocket or attachment gap 251 is formed by splitting upper portion 301 of expandable waistband 201 into two parts, an outer part 301A and an inner part 301B. In this way, pocket or attachment gap 251 is created just inside expandable waistband 201. Pocket or attachment gap 251 therefore exposes a portion 351 of rigid belt portion 111. This allows a device, such as a holster or tool, to be attached to portion 351 of rigid belt portion 111 of the disclosed dynamically adjustable rigid belt ring 100A or 100B. Of note, in one embodiment, pocket or attachment gap 251 does not extend through lower portion 303 of expandable waistband 201, i.e., lower portion 303 of expandable waistband 201 is fully stitched closed thereby creating a pocket or attachment gap 251 that is open at the upper portion 301 of expandable waistband 201 and closed at the lower portion 303 of expandable waistband 201.

As seen in FIG. 3B, in this one illustrative example, elastic portion 370 is attached between outer part 301A and an inner part 301B of upper portion 301 of expandable waistband 201 to provide a flap-like covering and to help secure a device, such as a holster or tool, that is attached to portion 351 of rigid belt portion 111.

As seen in FIG. 3B, in this one illustrative example, pocket or attachment gap 251 does not extend through lower portion 303 of expandable waistband 201, i.e., lower portion 303 of expandable waistband 201 is fully stitched closed thereby creating a pocket or attachment gap 251 that is open at the upper portion 301 of expandable waistband 201 and closed at the lower portion 303 of expandable waistband 201. This also helps secure a device, such as a holster or tool, that is attached to portion 351 of rigid belt portion 111.

In various embodiments, the disclosed dynamically expandable rigid waistband system such as those shown in FIG. 2A or 2B can include as many pockets or attachment gaps as desired. Consequently, the three attachment gaps 251, 253, and 255, of FIGS. 2A and 2B are merely representative of one illustrative example. In other embodiments, more or fewer attachment gaps can be formed in the disclosed dynamically expandable rigid waistband system such as those shown in FIG. 2A or 2B.

Figure 3C:
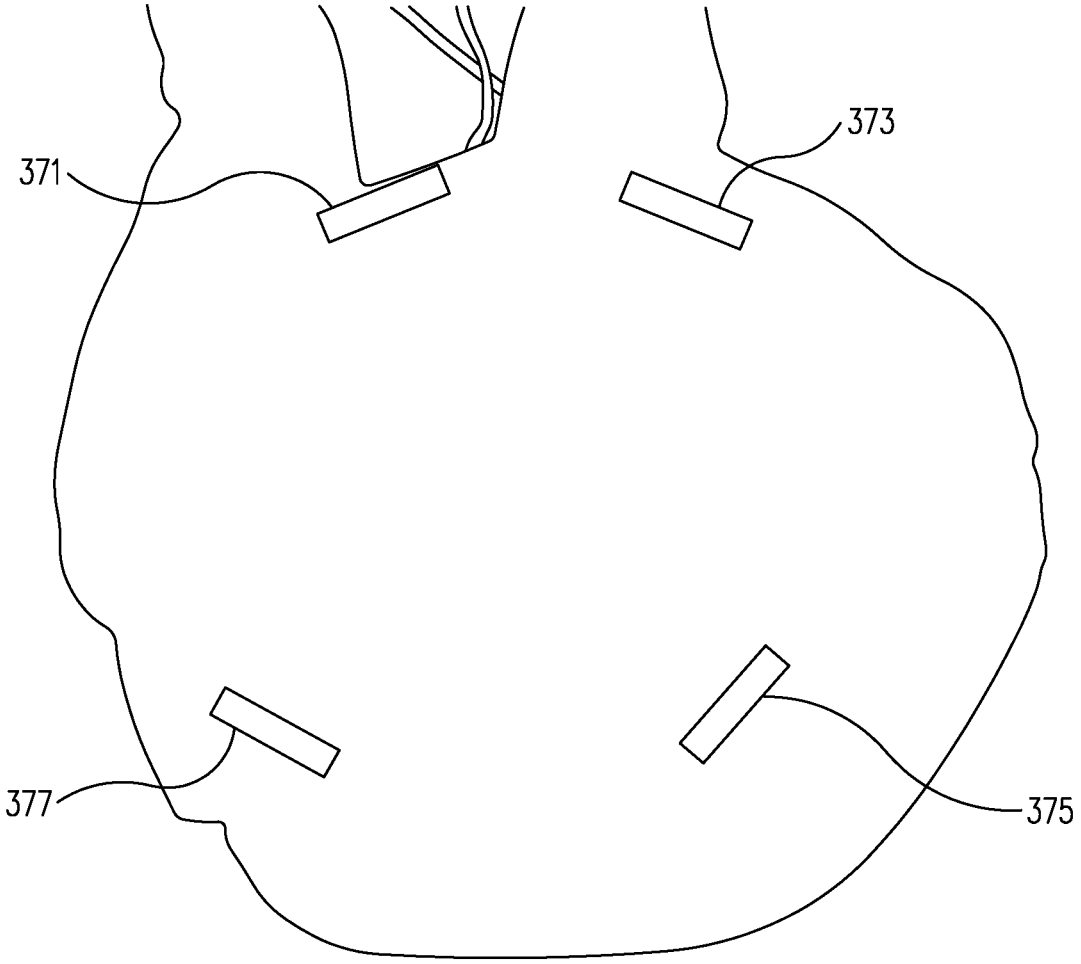
FIG. 3C is a representation of one example of the disclosed dynamically expandable rigid waistband system such as those shown in FIG. 2A or 2B integrated into a pair of athletic pants showing four pockets or attachment gaps where a device, such as a holster or tool, can be attached to dynamically adjustable rigid belt ring in accordance with one embodiment.

FIG. 3C is a representation of one example of the disclosed dynamically expandable rigid waistband system such as those shown in FIG. 2A or 2B integrated into a pair of athletic pants showing four pockets or attachment gaps 371, 373, 375, and 377, where a device, such as a holster or tool, can be attached to dynamically adjustable rigid belt ring in accordance with one embodiment.

In various embodiments, the pockets or attachment gaps can be placed at any position on the disclosed dynamically expandable rigid waistband system desired. Using a standard clock-based positional reference, in the specific illustrative example of FIG. 3C, the four pockets or attachment gaps 371, 373, 375, and 377 are positioned at the eleven o'clock, one o'clock, five o'clock, and seven o'clock positions, respectively.

Figure 4:
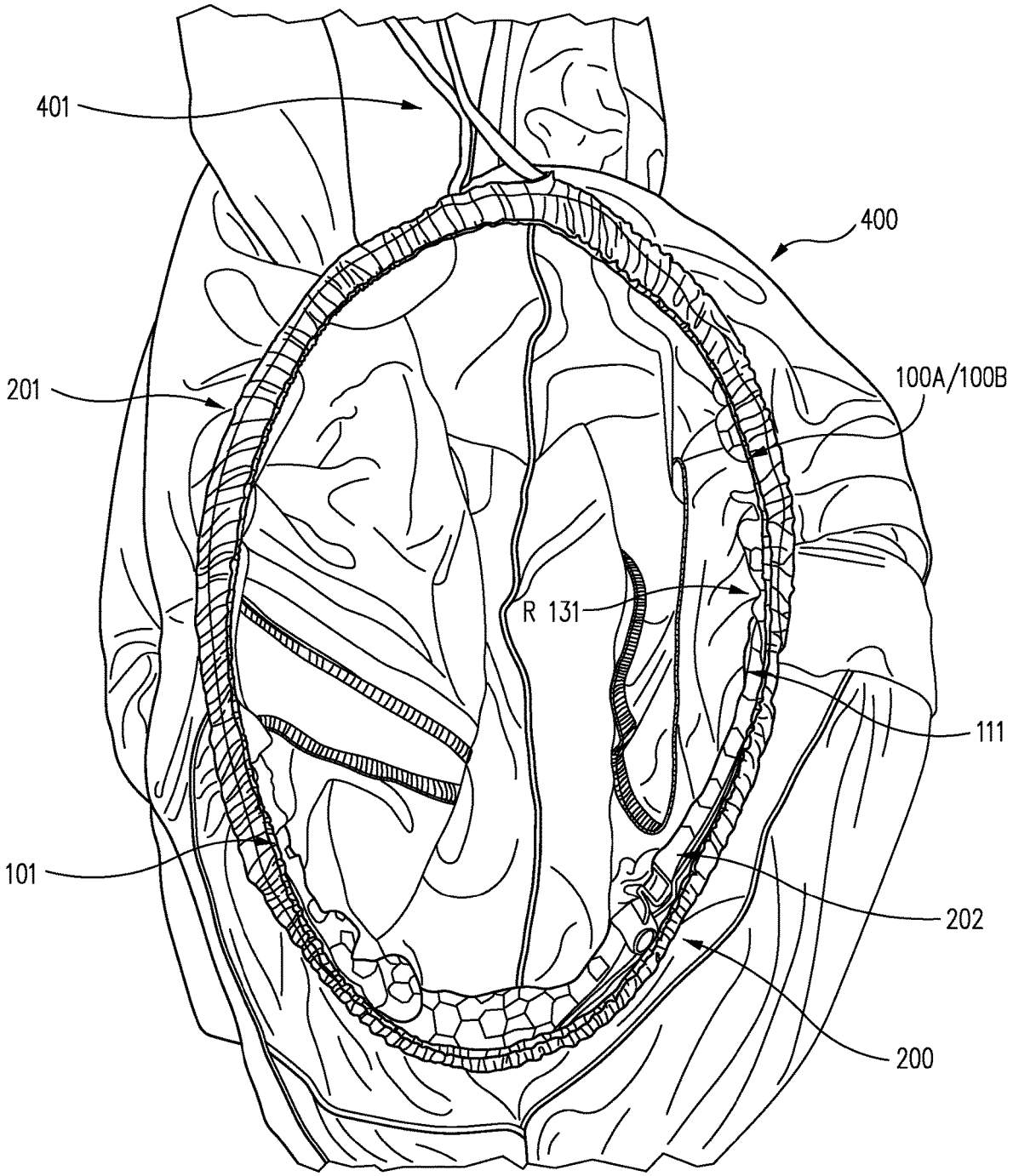
FIG. 4 is a representation of the disclosed dynamically expandable rigid waistband system such as those shown in FIG. 2A or 2B integrated into a pair of athletic pants.

FIG. 4 is a drawing of a dynamically expandable rigid waistband system 200 such as either of those shown in FIGS. 2A and/or 2B integrated into a garments that, in this illustrative example, is pair of athletic pants 400.

Referring to FIGS. 1A, 1B, 2A, 2B, 3, and 4 together, shown in FIG. 4 is athletic pants 400 including draw string 401 and dynamically expandable rigid waistband system 200. In this specific illustrative example, dynamically expandable rigid waistband system 200 includes expandable waistband portion 201 and dynamically adjustable rigid belt ring 100A or 100B, respectively encased, in this specific embodiment, in channel 202.

As also represented in FIG. 4, and shown in FIGS. 1A, 1B, 2A and 2B, dynamically adjustable rigid belt ring 100A or 100B includes first rigid belt portion 101 and second rigid belt portion 111 encased, in this specific embodiment, in channel 202.

Embodiments using dynamically expandable rigid waistband system 200A include the dynamically adjustable rigid belt ring 100A made up of the two rigid belt portions 101 and 111 of FIG. 1A coupled to an expandable and adjustable waistband portion 201.

Embodiments using dynamically expandable rigid waistband system 200B include the dynamically adjustable rigid belt ring 100B made up of the two rigid belt portions 101 and 111 of FIG. 1B coupled to an expandable and adjustable waistband portion 201.

Referring to FIGS. 1A, 2A, 3, and 4 together, dynamically adjustable rigid belt ring 100A including the two rigid belt portions 101 and 111 is coupled to expandable waistband portion 201. In the specific illustrative embodiment of FIG. 4, dynamically adjustable rigid belt ring 100A is coupled to expandable waistband portion 201 by being sewn inside a channel 202 which is, in turn, sewn or otherwise coupled to expandable waistband portion 201 with pockets or attachment gaps 211, 213, and 215 in channel 202 where a device, such as a holster or tool, can be directly attached to dynamically adjustable rigid belt ring 100A at portions 251, 253, and 255 of dynamically adjustable rigid belt ring 100A in this specific illustrative example.

In various embodiments, expandable waistband portion 201 can be, or can include, but is not limited to: elastic material, such as rubber or rubber compounds or synthetics; elastic material combined with cloth; elastic material combined with cotton; elastic material combined with any textile material; a draw string; a draw string combined with cloth, cotton or any other textile material; or any other expandable waistband material capable of dynamically expanding and contracting, as discussed herein, and/or as known in the art at the time of filing, and/or as developed/made know after the time of filing.

As noted above, end portion 103 of first rigid belt portion 101 and end portion 113 of second rigid belt portion 111 movably overlap, i.e., end portion 103 and end portion 113 can freely slide past each other in either direction 151 or 161, such that the overlap amount or length 133 can dynamically, i.e., automatically, adjust. Likewise, in one embodiment, end portion 105 of first rigid belt portion 101 and end portion 115 of second rigid belt portion 111 movably overlap, i.e., end portion 105 and end portion 115 can freely slide past each other in either direction 151 or 161, such that the overlap amount or length 135 can dynamically, i.e., automatically, adjust. This ability of end portions 103 and 113 and end portions 105 and 115 to freely slide past each other in either direction 151 or 161 results in the ability to dynamically, i.e., automatically, increase or decrease the circumference C 141, and radius R 131, of dynamically adjustable rigid belt ring 100A.

Consequently, dynamically adjustable rigid belt ring 100A thereby has a dynamically adjustable rigid belt ring circumference C 141 that can automatically increase or decrease as the movably overlapping end portions 103/113 and 105/115 of the rigid belt portions 101 and 111 are free to slide past each other and overlap each other by greater or smaller amounts 133 and 135.

As seen in FIG. 2A expandable waistband portion 201 has an adjustable radius RE 231 and adjustable circumference CE 241. In one embodiment, when adjustable circumference CE 241 of expandable waistband portion 201 increases the circumference C 141 of dynamically adjustable rigid belt ring 100A, coupled to the expandable waistband portion 201, also increases automatically as the movably overlapping end portions 103/113 and 105/115 of the two rigid belt portions 101 and 111 freely slide past each other in channel 202 and overlap each other by smaller amounts 133 and 135.

Similarly, when adjustable circumference CE 241 of expandable waistband portion 201 decreases the circumference C 141 of dynamically adjustable rigid belt ring 100A, coupled to the expandable waistband portion 201, also decreases automatically as the movably overlapping end portions 103/113 and 105/115 of the two rigid belt portions 101 and 111 freely slide past each other in channel 202 and overlap each other by larger amounts 133 and 135.

Referring to FIGS. 1B, 2B, 3, and 4 together, dynamically adjustable rigid belt ring 100B including the two rigid belt portions 101 and 111 is coupled to expandable waistband portion 201. In the specific illustrative embodiment of FIG. 4, dynamically adjustable rigid belt ring 100B is coupled to expandable waistband portion 201 by being sewn inside a channel 202 which is, in turn, sewn or otherwise coupled to expandable waistband portion 201 with pockets or attachment gaps 211, 213, and 215 in channel 202 where a device, such as a holster or tool, can be directly attached to dynamically adjustable rigid belt ring 100B at portions 251, 253, and 255 of dynamically adjustable rigid belt ring 100B in this specific illustrative example.

In various embodiments, expandable waistband portion 201 can be, or can include, but is not limited to: elastic material, such as rubber or rubber compounds or synthetics; elastic material combined with cloth; elastic material combined with cotton; elastic material combined with any textile material; a draw string; a draw string combined with cloth, cotton or any other textile material; or any other expandable waistband material capable of dynamically expanding and contracting, as discussed herein, and/or as known in the art at the time of filing, and/or as developed/made know after the time of filing.

As noted above, end portion 103 of first rigid belt portion 101 and end portion 113 of second rigid belt portion 111 are movably and elastically coupled by elastic connector portion 171, i.e., end portion 103 and end portion 113 can dynamically move closer or further from each other in either direction 151 or 161 as elastic connector portion 171 contracts or expands. Likewise, in one embodiment, end portion 105 of first rigid belt portion 101 and end portion 115 of second rigid belt portion 111 can dynamically move closer or further from each other in either direction 151 or 161 as elastic connector portion 173 contracts or expands. This ability of end portions 103 and 113 and end portions 105 and 115 to dynamically move closer or further from each other by virtue of the contraction or expansion of elastic connector portions 171 and 173 results in the ability to dynamically increase or decrease the circumference C 141, and radius R 131, of dynamically adjustable rigid belt ring 100B.

In various embodiments, elastic connector portion 171 and/or elastic connector portion 173 can be, or can include, but is not limited to: elastic material, such as rubber or rubber compounds or synthetics; elastic material combined with cloth; elastic material combined with cotton; elastic material combined with any textile material; or any other elastic material capable of dynamically expanding and contracting, as discussed herein, and/or as known in the art at the time of filing, and/or as developed/made know after the time of filing.

Consequently, dynamically adjustable rigid belt ring 100B thereby has a dynamically adjustable rigid belt ring circumference C 141 that can increase or decrease as end portions 103/113 and 105/115 of the rigid belt portions 101 and 111 dynamically move closer or further from each other by virtue of the contraction or expansion of elastic connector portions 171 and 173 by greater or smaller amounts 133 and 135.

As seen in FIG. 2B expandable waistband portion 201 has an adjustable radius RE 231 and adjustable circumference CE 241. In one embodiment, when adjustable circumference CE 241 of expandable waistband portion 201 increases the circumference C 141 of dynamically adjustable rigid belt ring 100B, coupled to the expandable waistband portion 201, also increases automatically as end portions 103/113 and 105/115 of the rigid belt portions 101 and 111 dynamically move further from each other by virtue of the expansion of elastic connector portions 171 and 173 by amounts 133 and 135.

Similarly, when adjustable circumference CE 241 of expandable waistband portion 201 decreases the circumference C 141 of dynamically adjustable rigid belt ring 100B, coupled to the expandable waistband portion 201, also decreases automatically as end portions 103/113 and 105/115 of the rigid belt portions 101 and 111 dynamically move closer to each other by virtue of the contraction of elastic connector portions 171 and 173 by amounts 133 and 135.

Figure 5:
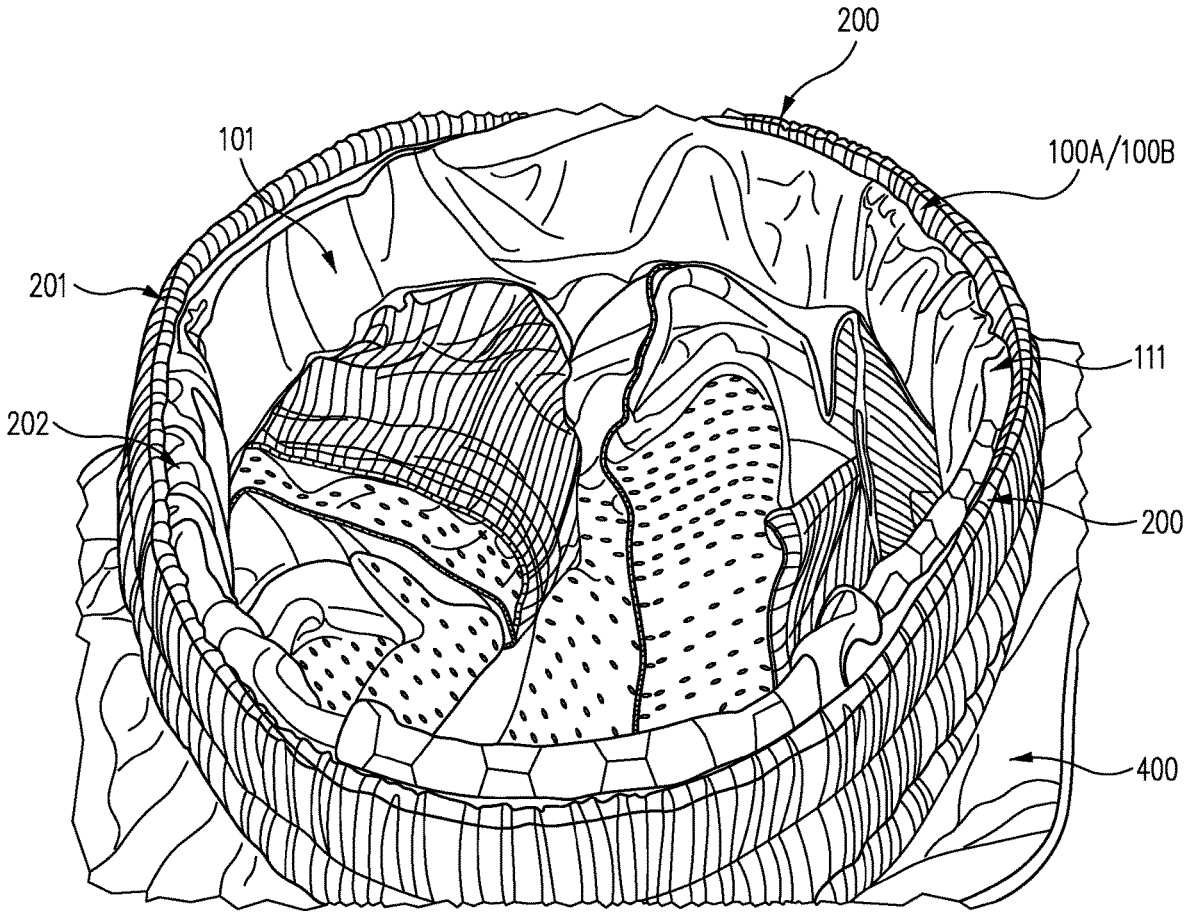
FIG. 5 is a second representation of the disclosed dynamically expandable rigid waistband system such as that shown in FIG. 2A or 2B integrated into a pair of athletic pants of FIG. 4.

FIG. 5 is a second drawing of a dynamically expandable rigid waistband system 200, such as dynamically expandable rigid waistband system 200A or dynamically expandable rigid waistband system 200B, integrated into the pair of athletic pants of FIG. 4.

Referring to FIGS. 1A, 1B, 2A, 2B, 3, 4, and 5 together, shown in FIG. 5 is athletic pants 400 including dynamically expandable rigid waistband system 200. In this specific illustrative example, dynamically expandable rigid waistband system 200 includes expandable waistband portion 201, and dynamically adjustable rigid belt ring 100A or 100B encased, in this specific embodiment, in channel 202.

As also represented in FIG. 5, and shown in FIGS. 1A, 1B, 2A and 2B, dynamically adjustable rigid belt ring 100A or 100B includes first rigid belt portion 101 and second rigid belt portion 111 encased, in this specific embodiment, in channel 202.

Figure 6:
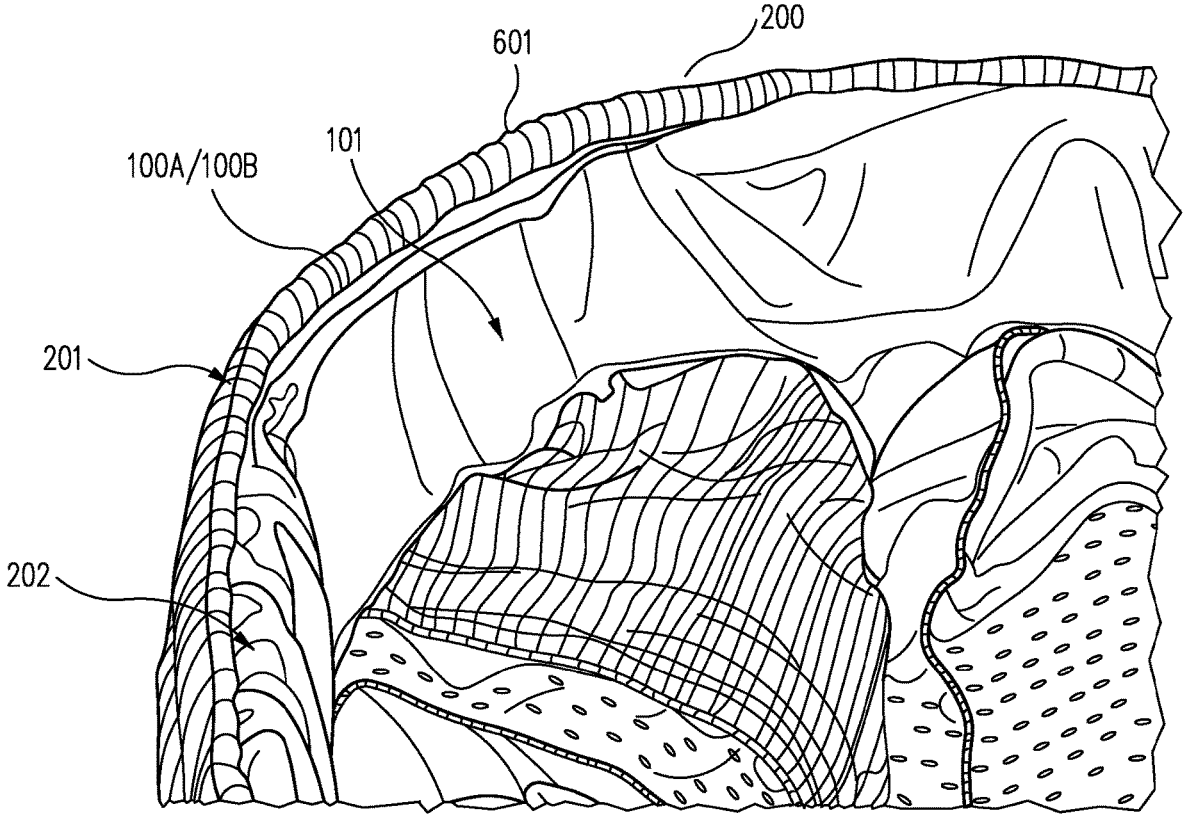
FIG. 6 is a third representation of the disclosed dynamically expandable rigid waistband system such as those shown in FIG. 2A or 2B integrated into a pair of athletic pants of FIG. 4.

FIG. 6 is a third drawing of a dynamically expandable rigid waistband system such as dynamically expandable rigid waistband system 200A or dynamically expandable rigid waistband system 200B, integrated into the pair of athletic pants of FIG. 4.

Referring to FIGS. 1A, 1B, 2A, 2B, 3, 4, 5, and 6 together, shown in FIG. 6 is dynamically expandable rigid waistband system 200, such as dynamically expandable rigid waistband system 200A or dynamically expandable rigid waistband system 200B. In this specific illustrative example, a portion 601 of dynamically expandable rigid waistband system 200 includes expandable waistband portion 201, and dynamically adjustable rigid belt ring 100A or 100B encased, in this specific embodiment, in channel 202.

As also represented in FIG. 6, and shown in FIGS. 1A, 1B, 2A, and 2B, dynamically adjustable rigid belt ring 100A or 100B includes first rigid belt portion 101 and second rigid belt portion 111 encased, in this specific embodiment, in channel 202.

Figure 7:
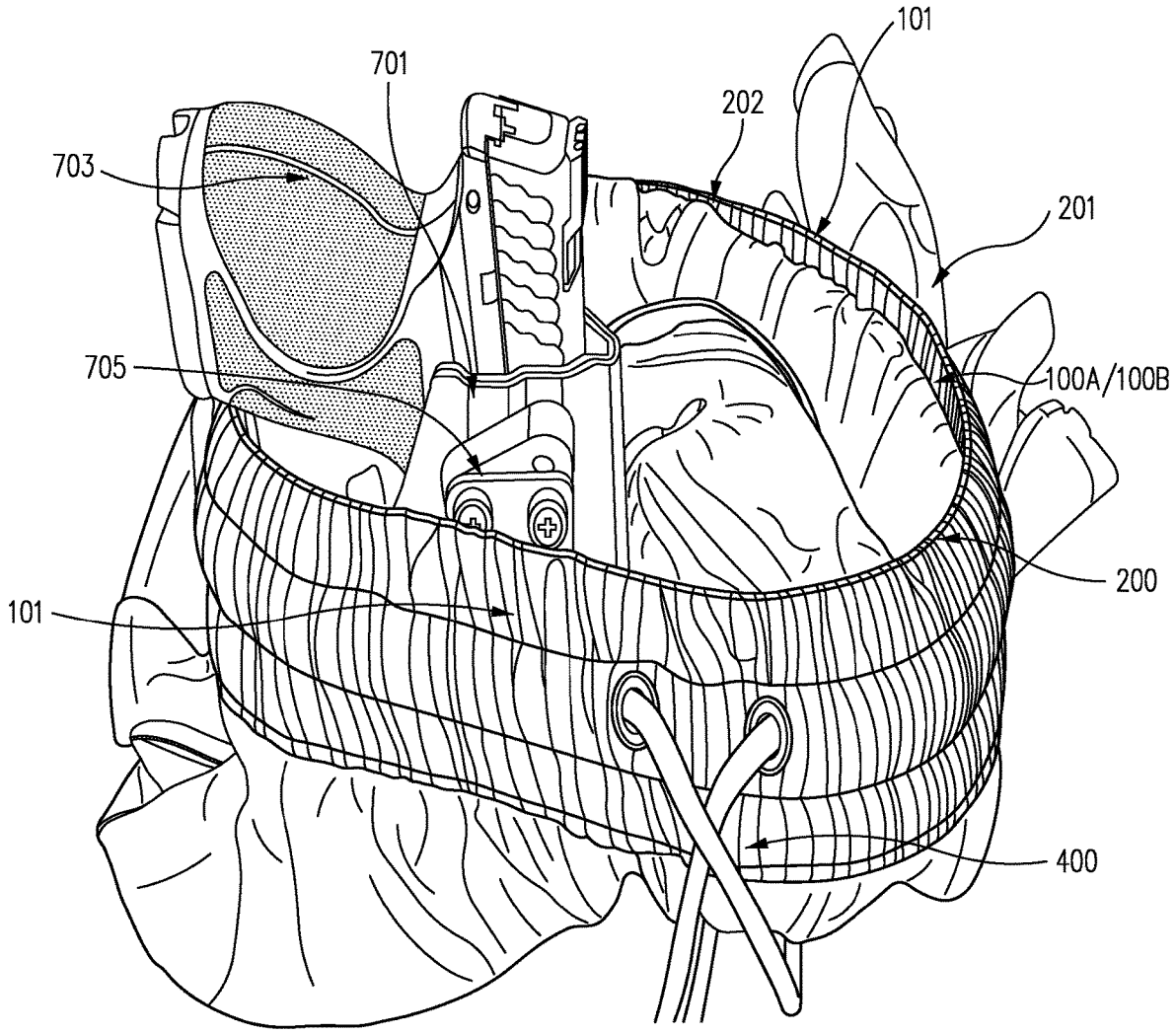
FIG. 7 is a fourth representation of the disclosed dynamically expandable rigid waistband system such as those shown in FIG. 2A or 2B integrated into a pair of athletic pants of FIG. 4 including an attached holster and firearm.

FIG. 7 is a fourth drawing of a dynamically expandable rigid waistband system integrated 200, such as dynamically expandable rigid waistband system 200A or dynamically expandable rigid waistband system 200B, into the pair of athletic pants of FIG. 4 including an attached holster and firearm.

Referring to FIGS. 1A, 1B, 2A, 2B, 3, 4, 5, 6, and 7 together, shown in FIG. 7 is athletic pants 400 including dynamically expandable rigid waistband system 200. In this specific illustrative example, dynamically expandable rigid waistband system 200 includes expandable waistband portion 201, and dynamically adjustable rigid belt ring 100A encased, in this specific embodiment, in channel 202.

As also represented in FIG. 7, and shown in FIGS. 1A, 1B, 2A, and 2B, dynamically adjustable rigid belt ring 100A or 100B includes first rigid belt portion 101 and second rigid belt portion 111 encased, in this specific embodiment, in channel 202.

As also represented in FIG. 7 is holster 701 including firearm 703 and holster attachment mechanism 705. As represented in FIG. 7, holster attachment mechanism 705 is clipped, or inserted, or otherwise attached to first rigid belt portion 101 of dynamically adjustable rigid belt ring 100A or 100B encased, in this specific embodiment, in channel 202. Consequently, holster 701 including firearm 703 is securely attached to first rigid belt portion 101 via holster attachment mechanism 705. Therefore, the disclosed dynamically expandable rigid waistband system 200, such as dynamically expandable rigid waistband system 200A or dynamically expandable rigid waistband system 200B, provides a solution to the long-standing technical problem of providing the comfort, range of motion, and adaptability of an expandable and adjustable waistband as well as a rigid structure for attaching devices, such as a holster/firearm or tool, safely and securely to the waistband.

Figure 8:
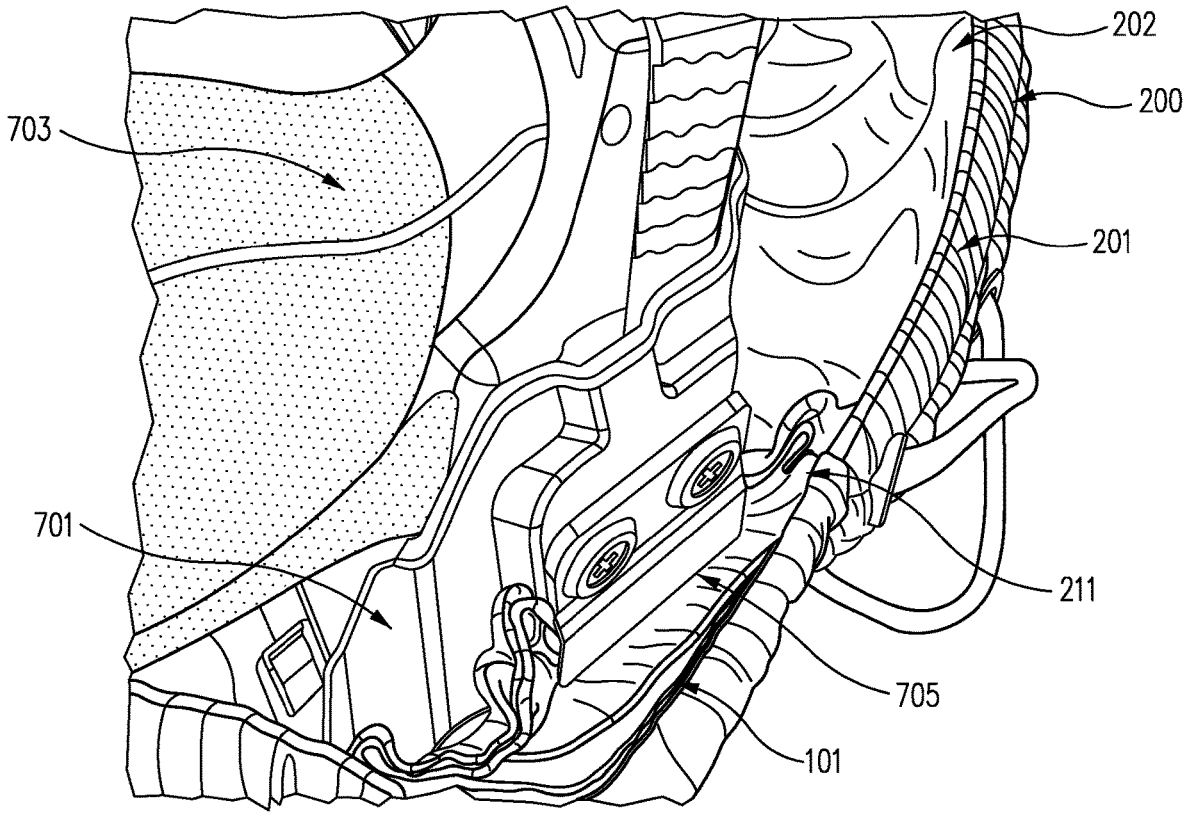
FIG. 8 is a fifth representation of the disclosed dynamically expandable rigid waistband system such as those shown in FIG. 2A or 2B integrated into a pair of athletic pants of FIG. 4 including an attached holster and firearm.

FIG. 8 is a fifth drawing of a dynamically expandable rigid waistband system such as dynamically expandable rigid waistband system 200A or dynamically expandable rigid waistband system 200B, integrated into the pair of athletic pants of FIG. 4 including an attached holster and firearm.

Referring to FIGS. 1A, 1B, 2A, 2B, 3, 4, 5, 6, 7, and 8 together, shown in FIG. 8 is dynamically expandable rigid waistband system 200 such as dynamically expandable rigid waistband system 200A or dynamically expandable rigid waistband system 200B. In this specific illustrative example, dynamically expandable rigid waistband system 200 includes expandable waistband portion 201, and first rigid belt portion 101 of dynamically adjustable rigid belt ring 100A encased, in this specific embodiment, in channel 202.

As also represented in FIG. 8 is holster 701 including firearm 703 and holster attachment mechanism 705. As represented in FIG. 8, holster attachment mechanism 705 is clipped, or inserted, or otherwise attached to first rigid belt portion 101 of dynamically adjustable rigid belt ring 100A or 100B encased, in this specific embodiment, in channel 202, in pockets or attachment gap 211. Consequently, holster 701 including firearm 703 is securely attached to first rigid belt portion 101 via holster attachment mechanism 705. Therefore, the disclosed dynamically expandable rigid waistband system 200 such as dynamically expandable rigid waistband system 200A or dynamically expandable rigid waistband system 200B, provides a solution to the long-standing technical problem of providing the comfort, range of motion, and adaptability of an expandable and adjustable waistband as well as a rigid structure for attaching devices, such as a holster/firearm or tool, safely and securely to the waistband.

In one embodiment, the disclosed dynamically adjustable rigid belt rings, such as the dynamically adjustable rigid belt rings 100A and 100B of FIG. 1A or 1B, are removably attached to the expandable waistband portion of a garment using one or more attachment mechanisms.

In various embodiments, the attachment mechanisms can include, but are not limited to, attachment clips; hoop and loop attachment mechanisms; or any other mechanism for removably attaching the disclosed dynamically adjustable rigid belt rings to an expandable waistband portion of a garment.

As noted above, in one embodiment, the attachment mechanism used for removably attaching the disclosed dynamically adjustable rigid belt rings to an expandable waistband portion of a garment is one or more clips. FIGS. 9A through 9D shows one illustrative example of the use of clips to removably attach the disclosed dynamically adjustable rigid belt rings to an expandable waistband portion of a garment.

FIG. 9A shows a disclosed dynamically adjustable rigid belt ring 100A or 100B, such as those shown in FIG. 1A or 1B, with four attachment clips 901 attached to the disclosed dynamically adjustable rigid belt ring 100A or 100B for removably attaching the disclosed dynamically adjustable rigid belt ring 100A or 100B to the expandable waistband portion of a garment in accordance with one embodiment.

FIG. 9B shows one illustrative example of an attachment clip 901 for removably attaching the disclosed dynamically adjustable rigid belt ring 100A or 100B to the expandable waistband portion of a garment in accordance with one embodiment. In the specific illustrative example of FIG. 9B, the attachment clip 901 is an attachment clip. In other embodiments, attachment clips, such as attachment clip 901, are permanently attached to dynamically adjustable rigid belt ring 100A or 100B.

In various embodiments, attachment clip 901 can be made of metal; plastic; or any other material capable of use in construction of an attachment clip 901 that is used to removably attach the disclosed dynamically adjustable rigid belt ring 100A or 100B to the expandable waistband portion of a garment.

FIG. 9C shows the disclosed dynamically adjustable rigid belt ring 100A or 100B, such as those shown in FIG. 1A or 1B, with four attachment clips 901 being positioned to be removably attached to the expandable waistband portion 201 of the pair of athletic pants 400 of FIG. 4 in accordance with one embodiment.

As seen in FIG. 9C, in this specific illustrative example, the four attachment clips 901 are to be hooked over both the disclosed dynamically adjustable rigid belt ring 100A or 100B and the expandable waistband portion 201 of the pair of athletic pants 400 so that the disclosed dynamically adjustable rigid belt ring 100A or 100B and the expandable waistband portion 201 of the pair of athletic pants 400 are clipped together and therefore removably attached. Also shown is drawstring 401 of the expandable waistband portion 201 of the pair of athletic pants 400 that can be used to adjust the circumference of expandable waistband portion 201 directly, and the circumference of the disclosed dynamically adjustable rigid belt ring 100A or 100B indirectly, as discussed above.

FIG. 9D shows the disclosed dynamically adjustable rigid belt ring 100A or 100B, such as those shown in FIG. 1A or 1B, removably attached to the expandable waistband portion of the pair of athletic pants of FIG. 4 using the four attachment clips in accordance with one embodiment. As seen in FIG. 9D, in this specific illustrative example, the four attachment clips 901 are hooked over both the disclosed dynamically adjustable rigid belt ring 100A or 100B and the expandable waistband portion 201 of the pair of athletic pants 400 so that the disclosed dynamically adjustable rigid belt ring 100A or 100B and the expandable waistband portion 201 of the pair of athletic pants 400 are clipped together and therefore removably attached. Also shown is drawstring 401 of the expandable waistband portion 201 of the pair of athletic pants 400 that can be used to adjust the circumference of expandable waistband portion 201 directly, and the circumference of the disclosed dynamically adjustable rigid belt ring 100A or 100B indirectly, as discussed above.

As discussed above, a dynamically expandable rigid waistband system is disclosed including an expandable waistband portion, the expandable waistband portion having a circumference that can increase and decrease and one or more rigid belt portions. In one embodiment, the one or more rigid belt portions each have rigid belt portion ends that movably overlap each other to form a dynamically adjustable rigid belt ring. The dynamically adjustable rigid belt ring therefore has a circumference that can increase or decrease as the movably overlapping ends of the one or more rigid belt portions slide past each other overlap each other by greater or smaller amounts.

In one embodiment, the dynamically adjustable rigid belt ring is coupled to the expandable waistband portion such that when the expandable and adjustable waistband portion circumference increases the dynamically adjustable rigid belt ring circumference also increases as the movably overlapping ends of the one or more rigid belt portions slide past each other and overlap each other by smaller amounts.

In one embodiment, the dynamically adjustable rigid belt ring is coupled to the expandable waistband portion such that when the expandable and adjustable waistband portion circumference decreases, the dynamically adjustable rigid belt ring circumference also decreases as the movably overlapping ends of the one or more rigid belt portions slide past each other and overlap each other by greater amounts.

In various embodiments, the expandable waistband portion is constructed of one or more the following components: elastic material, such as rubber or rubber compounds and synthetics; elastic material combined with cloth; elastic material combined with cotton; elastic material combined with any textile material; a draw string; a draw string combined with cloth; a draw string combined with cotton; and/or a draw string combined with or any textile material.

In various embodiments, the rigid belt portions are constructed of one or more of the following materials: nylon; polymer; leather; and/or metal.

In one embodiment, the rigid belt portions are movably attached to the expandable waistband portion by sewing the rigid belt portions into a channel attached to the expandable waistband portion.

In one embodiment, the rigid belt portions are movably attached to the expandable waistband portion by one or more attachment clips.

In one embodiment, the rigid belt portions are movably attached to the expandable waistband portion such that pockets or attachment gaps are created where a device, such as a holster or tool, can be directly attached to a portion of the dynamically adjustable rigid belt ring.

One embodiment disclosed is a dynamically expandable rigid waistband system including an expandable waistband portion, the expandable waistband portion having a circumference that can increase and decrease; and one or more rigid belt portions, the one or more rigid belt portions each having rigid belt portion ends that are elastically coupled to each other by at least one elastic connecting portion to form a dynamically adjustable rigid belt ring.

In one embodiment, the dynamically adjustable rigid belt ring therefore has a circumference that can increase or decrease as rigid belt portion ends dynamically move further or closer to each other as the at least one elastic connecting portion expands or contracts such that when the expandable and adjustable waistband portion circumference increases the dynamically adjustable rigid belt ring circumference also increases as the rigid belt portion ends dynamically move further from each other as the at least one elastic connecting portion expands.

In one embodiment, the dynamically adjustable rigid belt ring therefore has a circumference that can increase or decrease as rigid belt portion ends dynamically move further or closer to each other as the at least one elastic connecting portion expands or contracts such that when the expandable and adjustable waistband portion circumference decreases the dynamically adjustable rigid belt ring circumference also decreases as the rigid belt portion ends dynamically move closer to each other as the at least one elastic connecting portion contracts.

In various embodiments, the expandable waistband portion is constructed of one or more the following components: elastic material, such as rubber; elastic material combined with cloth; elastic material combined with cotton; elastic material combined with any textile material; a draw string; a draw string combined with cloth; a draw string combined with cotton; and/or a draw string combined with or any textile material.

In various embodiments, the rigid belt portions are constructed of one or more of the following materials: nylon; polymer; leather; and/or metal.

In various embodiments, the at least one elastic connecting portion is constructed of one or the following materials: elastic material, such as rubber or rubber compounds or synthetics; elastic material combined with cloth; elastic material combined with cotton; and/or elastic material combined with any textile material.

In one embodiment, the rigid belt portions are movably attached to the expandable waistband portion by sewing the rigid belt portions into a channel attached to the expandable waistband portion.

In one embodiment, the rigid belt portions are movably attached to the expandable waistband portion by one or more clips. In one embodiment, the clips are removable.

In one embodiment, the rigid belt portions are movably attached to the expandable waistband portion such that pockets or attachment gaps are created where a device, such as a holster or tool, can be directly attached to a portion of the dynamically adjustable rigid belt ring.

One embodiment disclosed is a garment including a dynamically expandable rigid waistband system. In one embodiment, the dynamically expandable rigid waistband system includes an expandable waistband portion, the expandable waistband portion having a circumference that can increase and decrease and one or more rigid belt portions, the one or more rigid belt portions each having rigid belt portion ends that are movably coupled to each other to form a dynamically adjustable rigid belt ring.

In one embodiment, the dynamically adjustable rigid belt ring therefore has a circumference that can increase or decrease such that when the expandable and adjustable waistband portion circumference increases the dynamically adjustable rigid belt ring circumference also increases.

In one embodiment, the dynamically adjustable rigid belt ring therefore has a circumference that can increase or decrease such that when the expandable and adjustable waistband portion circumference decreases, the dynamically adjustable rigid belt ring circumference also decreases.

In one embodiment, garment including a dynamically expandable rigid waistband system is constructed such that the one or more rigid belt portions each have rigid belt portion ends that movably overlap each other to form a dynamically adjustable rigid belt ring, the dynamically adjustable rigid belt ring thereby having a circumference that can increase or decrease as the movably overlapping ends of the one or more rigid belt portions slide past each other overlap each other by greater or smaller amounts.

In one embodiment, the dynamically adjustable rigid belt ring is coupled to the expandable waistband portion such that when the expandable and adjustable waistband portion circumference increases the dynamically adjustable rigid belt ring circumference also increases as the movably overlapping ends of the one or more rigid belt portions slide past each other and overlap each other by smaller amounts.

In one embodiment, the dynamically adjustable rigid belt ring is coupled to the expandable waistband portion such that when the expandable and adjustable waistband portion circumference decreases, the dynamically adjustable rigid belt ring circumference also decreases as the movably overlapping ends of the one or more rigid belt portions slide past each other and overlap each other by greater amounts.

In one embodiment, a garment including a dynamically expandable rigid waistband system is constructed such that the one or more rigid belt portions each have rigid belt portion ends that are elastically coupled to each other by at least one elastic connecting portion to form a dynamically adjustable rigid belt ring.

In one embodiment, the dynamically adjustable rigid belt ring therefore has a circumference that can increase or decrease as rigid belt portion ends dynamically move further or closer to each other as the at least one elastic connecting portion expands or contracts such that when the expandable and adjustable waistband portion circumference increases the dynamically adjustable rigid belt ring circumference also increases as the rigid belt portion ends dynamically move further from each other as the at least one elastic connecting portion expands.

In one embodiment, the dynamically adjustable rigid belt ring therefore has a circumference that can increase or decrease as rigid belt portion ends dynamically move further or closer to each other as the at least one elastic connecting portion expands or contracts such that when the expandable and adjustable waistband portion circumference decreases the dynamically adjustable rigid belt ring circumference also decreases as the rigid belt portion ends dynamically move closer to each other as the at least one elastic connecting portion contracts.

In various embodiments, the expandable waistband portion is constructed of one or more the following components: elastic material, such as rubber; elastic material combined with cloth; elastic material combined with cotton; elastic material combined with any textile material; a draw string; a draw string combined with cloth; a draw string combined with cotton; and/or a draw string combined with or any textile material.

In various embodiments, the rigid belt portions are constructed of one or more of the following materials: nylon; polymer; leather; and/or metal.

In various embodiments, the at least one elastic connecting portion is constructed of one or the following materials: elastic material, such as rubber or rubber compounds or synthetics; elastic material combined with cloth; elastic material combined with cotton; and/or elastic material combined with any textile material.

In one embodiment, the rigid belt portions are movably attached to the expandable waistband portion by sewing the rigid belt portions into a channel attached to the expandable waistband portion.

In one embodiment, the rigid belt portions are movably attached to the expandable waistband portion by one or more clips. In one embodiment, the clips are removable.

In one embodiment, the rigid belt portions are movably attached to the expandable waistband portion such that pockets or attachment gaps are created where a device, such as a holster or tool, can be directly attached to a portion of the dynamically adjustable rigid belt ring.

The present invention has been described in particular detail with respect to specific possible embodiments. Those of skill in the art will appreciate that the invention may be practiced in other embodiments. For example, the nomenclature used for components, capitalization of component designations and terms, the attributes, or structural aspect is not significant, mandatory, or limiting, and the mechanisms that implement the invention or its features can have various different names, formats, or protocols. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

In addition, the operations and structures shown in the figures, or as discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A dynamically expandable rigid waistband system comprising:

an expandable waistband portion, the expandable waistband portion having a circumference that can increase and decrease;

one or more rigid belt portions, the one or more rigid belt portions each having rigid belt portion ends that movably overlap each other to form a dynamically adjustable rigid belt ring, the dynamically adjustable rigid belt ring thereby having a circumference that can increase or decrease as the movably overlapping ends of the one or more rigid belt portions freely slide past each other to overlap each other by greater or smaller amounts, the dynamically adjustable rigid belt ring being coupled to the expandable waistband portion such that:

when the expandable and adjustable waistband portion circumference increases the dynamically adjustable rigid belt ring circumference also increases automatically as the movably overlapping ends of the one or more rigid belt portions freely slide past each other and overlap each other by smaller amounts; and when the expandable and adjustable waistband portion circumference decreases, the dynamically adjustable rigid belt ring circumference also decreases automatically as the movably overlapping ends of the one or more rigid belt portions freely slide past each other and overlap each other by greater amounts.

2. The dynamically expandable rigid waistband system of claim 1 wherein the expandable waistband portion is constructed of one or more of the following components:

elastic material;
elastic material combined with cloth;
elastic material combined with cotton;
elastic material combined with any textile material;
a draw string;
a draw string combined with cloth;
draw string combined with cotton; or
draw string combined with any textile material.

3. The dynamically expandable rigid waistband system of claim 1 wherein the rigid belt portions are constructed of one or more of the following materials:

nylon;
polymer;
leather; and
metal.

4. The dynamically expandable rigid waistband system of claim 1 wherein the dynamically adjustable rigid belt ring is coupled to the expandable waistband portion by sewing the rigid belt portions into a channel attached to the expandable waistband portion.

5. The dynamically expandable rigid waistband system of claim 1 wherein the dynamically adjustable rigid belt ring is coupled to the expandable waistband portion by one or more clips.

6. The dynamically expandable rigid waistband system of claim 1 wherein the rigid belt portions are movably attached to the expandable waistband portion such that pockets or attachment gaps are created where a device can be directly attached to a portion of the dynamically adjustable rigid belt ring.

7. A garment including a dynamically expandable rigid waistband system, the dynamically expandable rigid waistband system comprising:

an expandable waistband portion, the expandable waistband portion having a circumference that can increase and decrease;

one or more rigid belt portions, the one or more rigid belt portions each having rigid belt portion ends that movably overlap each other to form a dynamically adjustable rigid belt ring, the dynamically adjustable rigid belt ring thereby having a circumference that can increase or decrease as the movably overlapping ends of the one or more rigid belt portions freely slide past each other to overlap each other by greater or smaller amounts, such that:

when the expandable and adjustable waistband portion circumference increases the dynamically adjustable rigid belt ring circumference also increases automatically; and when the expandable and adjustable waistband portion circumference decreases, the dynamically adjustable rigid belt ring circumference also decreases automatically.

8. The garmet of claim 7 wherein the expandable waistband portion is constructed of one or more of the following components:

elastic material;

elastic material combined with cloth;

elastic material combined with cotton;

elastic material combined with any textile material;

a draw string;

a draw string combined with cloth;

draw string combined with cotton; or draw string combined with any textile material.

9. The garmet of claim 7 wherein the rigid belt portions are constructed of one or more of the following materials:

nylon;

polymer;

leather; and metal.

10. The garmet of claim 7 wherein the rigid belt portions are movably attached to the expandable waistband portion by sewing the rigid belt portions into a channel attached to the expandable waistband portion.

11. The garmet of claim 7 wherein the rigid belt portions are movably attached to the expandable waistband portion by one or more clips.

* * * * *